US008215520B2

(12) United States Patent
Miller et al.

(10) Patent No.: US 8,215,520 B2
(45) Date of Patent: Jul. 10, 2012

(54) SECURE MERCHANDISING SYSTEM

(75) Inventors: Roger K. Miller, East Bend, NC (US); Paul Dowd, Scarsdale, NY (US); Patrick Davey Shealey, Lewisville, NC (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 856 days.

(21) Appl. No.: 12/262,249

(22) Filed: Oct. 31, 2008

(65) Prior Publication Data

US 2009/0184130 A1 Jul. 23, 2009

Related U.S. Application Data

(63) Continuation-in-part of application No. 11/528,032, filed on Sep. 27, 2006, now Pat. No. 7,641,072, which is a continuation-in-part of application No. 10/967,811, filed on Oct. 18, 2004, now abandoned, said application No. 11/528,032 is a continuation-in-part of application No. 11/409,885, filed on Apr. 24, 2006, now abandoned.

(60) Provisional application No. 61/001,193, filed on Oct. 31, 2007, provisional application No. 60/720,823, filed on Sep. 27, 2005, provisional application No. 60/512,454, filed on Oct. 17, 2003, provisional application No. 60/674,880, filed on Apr. 25, 2005.

(51) Int. Cl.

| | |
|---|---|
| ***G07F 11/00*** | (2006.01) |
| ***B65H 3/44*** | (2006.01) |
| ***B65G 59/00*** | (2006.01) |

(52) U.S. Cl. ..... 221/129; 221/229; 221/279; 221/282; 221/59.2; 221/128; 221/263; 221/59.3; 221/59.4; 221/184; 221/51; 221/75; 221/76; 221/13; 221/90; 221/242; 221/247; 221/12; 221/125; 221/127; 221/191; 221/248; 221/194; 312/126; 312/71; 312/291

(58) Field of Classification Search ..... 221/229, 221/279, 282, 90, 59.2, 128, 123, 263, 59.3, 221/59.4, 184, 51, 75, 76, 13, 242, 129, 247, 221/12, 125, 127, 191, 248, 194; 211/59.3, 211/189, 184; 312/126, 71, 291
See application file for complete search history.

(56) References Cited

U.S. PATENT DOCUMENTS 691,990 A 1/1902 Warren
(Continued)

FOREIGN PATENT DOCUMENTS

DE 20 2005 010 088 U1 10/2005
(Continued)

OTHER PUBLICATIONS

English-language abstract of JP2005049965 published Feb. 24, 2005, Satoru.

(Continued)

*Primary Examiner* — Gene Crawford
*Assistant Examiner* — Rakesh Kumar
(74) *Attorney, Agent, or Firm* — Kilpatrick Townsend & Stockton LLP

(57) ABSTRACT

Systems for deterring theft of retail products. Systems of this invention provide theft deterrent dispensing modules for dispensing products and may incorporate theft deterrent measures including mechanical deterrents, time delays and sound. The dispensing modules may include one or more pusher assemblies for dispensing product. Certain systems of this invention may also include a lockout feature, so that one only pusher assembly may be activated to dispense a product at one time. In some embodiments, a door assembly may be provided as an additional theft deterrent mechanism so that access to additional product not yet dispensed by the pusher assembly is restricted.

33 Claims, 22 Drawing Sheets

U.S. PATENT DOCUMENTS

| | | | | | |
|---|---|---|---|---|---|
| 1,034,318 | A | | 7/1912 | Sobretto et al. | |
| 1,123,071 | A | * | 12/1914 | Bell | 194/286 |
| 1,319,084 | A | | 10/1919 | Hume | |
| 1,533,147 | A | | 4/1925 | Svendsgaard | |
| 1,592,720 | A | | 7/1926 | Butler | |
| 1,614,363 | A | | 1/1927 | Hicks | |
| 1,680,275 | A | | 8/1928 | Albaugh | |
| 1,755,655 | A | | 4/1930 | Langenfeld | |
| 1,813,935 | A | | 7/1931 | Knee | |
| 1,841,926 | A | | 1/1932 | Wray | |
| 1,913,843 | A | | 6/1933 | Marcuse | |
| 2,142,053 | A | | 12/1938 | Hoban | |
| 2,163,280 | A | | 6/1939 | Hibshman | |
| 2,304,533 | A | | 12/1942 | Bright | |
| 2,412,368 | A | | 2/1945 | Tascher | |
| 2,824,666 | A | | 2/1958 | Hausladen | |
| 2,977,023 | A | | 3/1961 | Meyer | |
| 3,161,295 | A | | 12/1964 | Chesley | |
| 3,199,724 | A | | 8/1965 | Domenico et al. | |
| 3,313,448 | A | | 4/1967 | Howard et al. | |
| 3,351,233 | A | | 11/1967 | Chanoch et al. | |
| 3,452,899 | A | | 7/1969 | Libberton | |
| 3,578,207 | A | | 5/1971 | Danow | |
| 3,583,568 | A | | 6/1971 | Crossien | |
| 3,591,048 | A | | 7/1971 | Myers | |
| 3,749,279 | A | | 7/1973 | Ungerman | |
| 3,752,357 | A | | 8/1973 | Harris | |
| 3,776,418 | A | | 12/1973 | Bookout | |
| 3,796,345 | A | | 3/1974 | Fessler | |
| 3,805,962 | A | | 4/1974 | Bendiksen | |
| 3,923,159 | A | | 12/1975 | Taylor et al. | |
| 3,957,173 | A | | 5/1976 | Roudebush | |
| 3,968,900 | A | | 7/1976 | Stambuk | |
| 3,999,662 | A | | 12/1976 | Barnhardt | |
| 4,007,853 | A | | 2/1977 | Bahneman | |
| 4,010,869 | A | | 3/1977 | Adamo | |
| 4,018,100 | A | | 4/1977 | Moe | |
| 4,190,179 | A | * | 2/1980 | Moss et al. | 221/299 |
| 4,228,903 | A | | 10/1980 | Eckert | |
| 4,275,819 | A | | 6/1981 | Perez | |
| 4,308,974 | A | | 1/1982 | Jones | |
| 4,336,892 | A | | 6/1982 | Cox et al. | |
| 4,369,887 | A | | 1/1983 | Emery | |
| 4,371,093 | A | * | 2/1983 | Berger | 221/90 |
| 4,412,607 | A | | 11/1983 | Collins et al. | |
| 4,474,300 | A | | 10/1984 | Entis | |
| 4,506,607 | A | | 3/1985 | Jacoby | |
| 4,576,272 | A | * | 3/1986 | Morgan et al. | 194/215 |
| 4,679,684 | A | | 7/1987 | Glaser | |
| 4,682,826 | A | | 7/1987 | Mestdagh | |
| 4,779,760 | A | | 10/1988 | Wittern et al. | |
| 4,852,767 | A | | 8/1989 | Humphrey | |
| 4,887,737 | A | * | 12/1989 | Adenau | 221/3 |
| 4,954,760 | A | | 9/1990 | Futch et al. | |
| 4,962,867 | A | | 10/1990 | Ficken et al. | |
| 4,965,551 | A | | 10/1990 | Box | |
| 5,012,936 | A | | 5/1991 | Crum | |
| 5,046,641 | A | | 9/1991 | Gray | |
| 5,067,634 | A | | 11/1991 | Guindulain Vidondo | |
| 5,096,367 | A | | 3/1992 | Winski | |
| 5,097,611 | A | | 3/1992 | Smollar et al. | |
| 5,111,942 | A | | 5/1992 | Bernardin | |
| 5,121,854 | A | | 6/1992 | Trouteaud et al. | |
| 5,150,101 | A | | 9/1992 | Goris et al. | |
| 5,169,027 | A | | 12/1992 | Falk et al. | |
| 5,199,598 | A | | 4/1993 | Sampson | |
| 5,229,749 | A | | 7/1993 | Yenglin | |
| 5,232,102 | A | | 8/1993 | Ozawa | |
| 5,240,126 | A | | 8/1993 | Foster et al. | |
| 5,248,060 | A | | 9/1993 | Friedman et al. | |
| 5,249,705 | A | | 10/1993 | Gates | |
| 5,252,948 | A | | 10/1993 | Goris et al. | |
| 5,263,596 | A | * | 11/1993 | Williams | 221/153 |
| 5,269,597 | A | * | 12/1993 | Yenglin et al. | 312/42 |
| 5,285,926 | A | | 2/1994 | Falk et al. | |
| 5,335,816 | A | | 8/1994 | Kaufman et al. | |
| 5,335,818 | A | | 8/1994 | Maldanis | |
| 5,360,134 | A | | 11/1994 | Falk | |
| 5,375,735 | A | | 12/1994 | Huvey et al. | |
| 5,375,737 | A | * | 12/1994 | Ficken | 221/194 |
| 5,385,266 | A | | 1/1995 | Pate | |
| 5,397,025 | A | | 3/1995 | Lee | |
| 5,400,919 | A | | 3/1995 | Gomm et al. | |
| 5,439,136 | A | | 8/1995 | Chatani et al. | |
| 5,450,969 | A | | 9/1995 | Johnson et al. | |
| 5,460,294 | A | | 10/1995 | Williams | |
| 5,462,198 | A | | 10/1995 | Schwimmer | |
| 5,542,552 | A | | 8/1996 | Yablans et al. | |
| 5,632,408 | A | | 5/1997 | Mitchell | |
| 5,665,304 | A | | 9/1997 | Heinen et al. | |
| 5,709,315 | A | | 1/1998 | Kahler et al. | |
| 5,790,409 | A | | 8/1998 | Fedor et al. | |
| 5,813,568 | A | | 9/1998 | Lowing | |
| 5,855,281 | A | | 1/1999 | Rabas | |
| 5,909,932 | A | | 6/1999 | Shih | |
| 5,960,984 | A | | 10/1999 | Weston | |
| 5,960,988 | A | | 10/1999 | Freixas | |
| 6,084,511 | A | | 7/2000 | Kil | |
| 6,131,748 | A | | 10/2000 | Kawasaki et al. | |
| 6,176,558 | B1 | * | 1/2001 | Hlade et al. | 312/42 |
| 6,196,416 | B1 | | 3/2001 | Seagle | |
| 6,199,720 | B1 | | 3/2001 | Rudick et al. | |
| 6,206,237 | B1 | | 3/2001 | Dillon et al. | |
| 6,230,932 | B1 | | 5/2001 | Lowing et al. | |
| 6,241,121 | B1 | | 6/2001 | Yasaka | |
| 6,263,259 | B1 | | 7/2001 | Bartur | |
| 6,301,501 | B1 | | 10/2001 | Cronin et al. | |
| 6,318,591 | B1 | | 11/2001 | Martin | |
| 6,325,242 | B1 | | 12/2001 | Izawa et al. | |
| 6,454,107 | B1 | | 9/2002 | Belanger et al. | |
| 6,464,089 | B1 | | 10/2002 | Rankin | |
| 6,474,478 | B1 | | 11/2002 | Huehner et al. | |
| 6,478,187 | B2 | | 11/2002 | Simson et al. | |
| 6,520,604 | B1 | | 2/2003 | Yasaka et al. | |
| 6,581,798 | B2 | | 6/2003 | Liff et al. | |
| 6,601,416 | B1 | | 8/2003 | Sanders | |
| 6,604,652 | B1 | | 8/2003 | Trautwein | |
| 6,622,979 | B2 | | 9/2003 | Valiulis | |
| 6,659,291 | B2 | | 12/2003 | Huchner et al. | |
| 6,684,126 | B2 | | 1/2004 | Omura et al. | |
| 6,691,891 | B2 | | 2/2004 | Maldonado | |
| 6,694,221 | B2 | | 2/2004 | Chavez et al. | |
| 6,735,473 | B2 | | 5/2004 | Kolder et al. | |
| D491,403 | S | | 6/2004 | Gervasi | |
| 6,758,370 | B2 | | 7/2004 | Cooke et al. | |
| 6,776,304 | B2 | | 8/2004 | Liff et al. | |
| 6,786,341 | B2 | | 9/2004 | Stinnett et al. | |
| 6,814,254 | B2 | | 11/2004 | Liff et al. | |
| 6,814,255 | B2 | | 11/2004 | Liff et al. | |
| 6,857,539 | B2 | | 2/2005 | Parra | |
| 6,892,898 | B1 | | 5/2005 | Boone et al. | |
| 6,957,555 | B1 | | 10/2005 | Nagel et al. | |
| 7,007,810 | B2 | | 3/2006 | Huehner et al. | |
| 7,017,778 | B2 | | 3/2006 | Halbherr | |
| 7,024,894 | B2 | | 4/2006 | Salonen | |
| 7,032,776 | B2 | | 4/2006 | Hieb | |
| D521,363 | S | | 5/2006 | Copen | |
| 7,086,541 | B2 | | 8/2006 | Robertson | |
| 7,128,221 | B2 | | 10/2006 | Metcalf | |
| 7,128,239 | B2 | | 10/2006 | Skavnak | |
| 7,149,600 | B2 | | 12/2006 | Rippolone | |
| 7,150,365 | B2 | | 12/2006 | Hardy et al. | |
| 7,151,982 | B2 | | 12/2006 | Liff et al. | |
| 7,178,678 | B2 | | 2/2007 | Mansfield et al. | |
| 7,197,902 | B1 | | 4/2007 | Barkdoll | |
| 7,207,447 | B2 | | 4/2007 | Medcalf et al. | |
| 7,213,722 | B2 | | 5/2007 | Nagelski et al. | |
| 7,246,711 | B1 | | 7/2007 | Metcalf | |
| 7,249,761 | B2 | | 7/2007 | Graef et al. | |
| 7,264,138 | B2 | * | 9/2007 | Collins et al. | 221/191 |
| 7,269,983 | B1 | | 9/2007 | Mchatet | |
| 7,293,672 | B2 | | 11/2007 | Mori | |
| 7,299,934 | B2 | | 11/2007 | Hardy et al. | |
| 7,303,095 | B2 | | 12/2007 | Nagelski | |
| 7,347,335 | B2 | | 3/2008 | Rankin et al. | |
| 7,348,884 | B2 | | 3/2008 | Higham | |
| 7,389,886 | B2 | | 6/2008 | Hardy et al. | |

| | | | | |
|---|---|---|---|---|
| 7,451,881 | B2 | 11/2008 | Hardy et al. | |
| 7,469,791 | B2 | 12/2008 | Phoy | |
| 7,497,341 | B2 | 3/2009 | Hardy et al. | |
| 7,533,784 | B2 | 5/2009 | Vlastakis et al. | |
| 7,564,351 | B2 | 7/2009 | Nagelski et al. | |
| 7,621,409 | B2 | 11/2009 | Hardy et al. | |
| 7,641,072 | B1 | 1/2010 | Vlastakis et al. | |
| 7,661,545 | B2 | 2/2010 | Hardy et al. | |
| 7,669,722 | B2 | 3/2010 | Hardy et al. | |
| 7,675,421 | B2 | 3/2010 | Higham | |
| 7,768,399 | B2 | 8/2010 | Hachmann et al. | |
| 7,823,734 | B2 | 11/2010 | Hardy | |
| 7,828,158 | B2 | 11/2010 | Colelli et al. | |
| 8,013,740 | B2 | 9/2011 | Irmscher et al. | |
| 8,047,385 | B2 | 11/2011 | Hardy | |
| 8,056,734 | B2 | 11/2011 | Menz et al. | |
| 8,056,740 | B2 | 11/2011 | Weshler et al. | |
| 2003/0029816 | A1 | 2/2003 | Huchner et al. | |
| 2003/0121929 | A1 | 7/2003 | Liff et al. | |
| 2003/0178435 | A1 | 9/2003 | Yamaguchi | |
| 2003/0189058 | A1 | 10/2003 | Liff et al. | |
| 2004/0026344 | A1 | 2/2004 | Sedon et al. | |
| 2004/0059464 | A1 | 3/2004 | Veenstra et al. | |
| 2004/0060944 | A1* | 4/2004 | Gervasi | 221/263 |
| 2004/0084386 | A1 | 5/2004 | Huchner et al. | |
| 2004/0104239 | A1 | 6/2004 | Black et al. | |
| 2004/0149768 | A1 | 8/2004 | Scoville et al. | |
| 2004/0238557 | A1 | 12/2004 | Chimomas | |
| 2005/0029205 | A1 | 2/2005 | Mansfield et al. | |
| 2005/0029283 | A1 | 2/2005 | Pedigo | |
| 2005/0065645 | A1 | 3/2005 | Liff et al. | |
| 2005/0189369 | A1* | 9/2005 | Vlastakis et al. | 221/123 |
| 2005/0189370 | A1 | 9/2005 | Carter et al. | |
| 2005/0199644 | A1 | 9/2005 | Barili et al. | |
| 2005/0205596 | A1 | 9/2005 | Kelly | |
| 2005/0252925 | A1 | 11/2005 | Kelly | |
| 2006/0138915 | A1 | 6/2006 | Goldberg | |
| 2006/0157431 | A1 | 7/2006 | Nagelski et al. | |
| 2006/0219730 | A1 | 10/2006 | Handfield et al. | |
| 2006/0237381 | A1 | 10/2006 | Lockwood et al. | |
| 2006/0266762 | A1* | 11/2006 | Andrews et al. | 221/45 |
| 2007/0029340 | A1 | 2/2007 | Nagelski et al. | |
| 2007/0078561 | A1 | 4/2007 | Sansone | |
| 2007/0080175 | A1 | 4/2007 | Peterson | |
| 2007/0119796 | A1 | 5/2007 | Barkdoll | |
| 2007/0199863 | A1 | 8/2007 | Knoettgen-Nap | |
| 2007/0221679 | A1 | 9/2007 | Chandler et al. | |
| 2007/0251900 | A1 | 11/2007 | Hardy | |
| 2007/0273513 | A1 | 11/2007 | White | |
| 2007/0278164 | A1 | 12/2007 | Lang et al. | |
| 2007/0283615 | A1 | 12/2007 | Vlastakis | |
| 2008/0092394 | A1 | 4/2008 | Freitag et al. | |
| 2008/0142538 | A1 | 6/2008 | Miller | |
| 2008/0246375 | A1 | 10/2008 | Berg | |
| 2008/0283477 | A1 | 11/2008 | Wamsley et al. | |
| 2009/0084745 | A1 | 4/2009 | Goehring | |
| 2009/0166304 | A1 | 7/2009 | Hardy et al. | |
| 2009/0184069 | A1 | 7/2009 | Hardy | |
| 2009/0184129 | A1 | 7/2009 | Vlastakis et al. | |
| 2009/0242582 | A1 | 10/2009 | Vlastakis et al. | |
| 2009/0321373 | A1 | 12/2009 | Hardy | |
| 2010/0017025 | A1 | 1/2010 | Lockwood | |
| 2010/0079240 | A1 | 4/2010 | Higham | |
| 2010/0147783 | A1 | 6/2010 | Hardy | |
| 2010/0188221 | A1 | 7/2010 | Irmscher et al. | |
| 2011/0017763 | A1 | 1/2011 | Colelli et al. | |
| 2011/0042331 | A1 | 2/2011 | Johnson et al. | |
| 2011/0042332 | A1 | 2/2011 | Hardy | |
| 2011/0094975 | A1 | 4/2011 | Hardy | |
| 2011/0210084 | A1 | 9/2011 | Hardy | |
| 2011/0220597 | A1 | 9/2011 | Sherretts et al. | |
| 2011/0240569 | A1 | 10/2011 | Kahl et al. | |
| 2011/0284488 | A1 | 11/2011 | Hardy | |
| 2011/0315706 | A1 | 12/2011 | Lockwood | |
| 2012/0000869 | A1 | 1/2012 | Hardy | |

FOREIGN PATENT DOCUMENTS

| | | | |
|---|---|---|---|
| DE | 20 2005 019 621 | U1 | 3/2006 |
| DE | 20 2007 011 927 | U1 | 12/2007 |
| EP | 1 541 064 | B1 | 6/2005 |
| WO | WO89/12873 | | 12/1989 |
| WO | WO2004028311 | | 4/2004 |
| WO | WO 2007/054042 | A1 | 5/2007 |
| WO | WO 2006/085211 | A1 | 8/2007 |
| WO | 2010094778 | | 8/2010 |

OTHER PUBLICATIONS

English-language abstract of JP1144185A published Jun. 6, 1989, Mizobuchi, et al.

English-language abstract of JP2219194A published Aug. 31, 1990, Watanabe.

English-language abstract of JP9319937A published Dec. 12, 1997, Horiguchi, et al.

English-language abstract of JP2006285930 published Oct. 19, 2006, Mukai.

International Preliminary Report on Patentability dated Dec. 15, 2011 in Application No. PCT/US2010/037026.

Annex to Form PCTIISA1206—Communication Relating to the Results of the Partial International Search dated Aug. 20, 2010 in related Application No. PCT/US2010/037026.

* cited by examiner

SECURE MERCHANDISING SYSTEM

CROSS-REFERENCE TO RELATED APPLICATIONS

This application claims priority to U.S. Provisional Application No. 61/001,193, filed Oct. 31, 2007, the entire contents of which are herein incorporated by reference. This application is a continuation-in-part application of U.S. application Ser. No. 11/528,032, filed Sep. 27, 2006, which claims priority to U.S. Application Ser. No. 60/720,823, filed Sep. 27, 2005, and which is a continuation-in-part application of U.S. application Ser. No. 10/967,811, filed Oct. 18, 2004, which claims priority to U.S. Application Ser. No. 60/512,454, filed on Oct. 17, 2003, and which is a continuation-in-part application of U.S. application Ser. No. 11/409,885, filed Apr. 24, 2006, which claims priority to U.S. Application Ser. No. 60/674,880, filed Apr. 25, 2005, the entire contents of all of which are herein incorporated by reference. This application is a continuation-in-part application of U.S. application Ser. No. 11/409,885, filed Apr. 24, 2006, which claims priority to U.S. Application Ser. No. 60/674,880, filed Apr. 25, 2005, the entire contents of all of which are herein incorporated by reference.

BACKGROUND

1. Field of the Invention

The invention generally relates to secure merchandising systems for dispensing products. More specifically, the invention relates to dispensing devices that incorporate theft deterrent measures, such as time delays and sound.

2. General Background

Theft of small items in retail stores is an all too common problem. Items that are in high demand by thieves include over-the-counter (OTC) products such as analgesics and cough and cold medications, razor blades, camera film, batteries, videos, DVDs, smoking cessation products, fragrances, and infant formula. Shelf sweeping is a particular problem for small items. Shelf sweeping occurs when individuals or groups remove all the shelf stock and exit the store, similar to a "smash and grab" shoplifting technique. Shelf sweeping relies on excessive quantities of product being available on the shelf. Retailers must keep substantial inventory on shelf or incur the cost of constantly restocking.

In addition to preventing theft, retail stores may want to limit the purchase of certain items. For example, to make methamphetamine, large quantities of cold medication are needed. Pseudoephedrine, the sole active ingredient in many cold medicines and decongestants, is also a key ingredient in methamphetamine, a powerful and highly addictive stimulant.

Retailers are constantly challenged to balance the needs of legitimate consumers' access to high theft items with measures to minimize the incidence of theft. It has long been known to place items such as cigarettes, sodas and newspapers in vending machines. Such machines require complete self-service by the customer. The customer places money into the vending machine and the machine dispenses the desired item. Typical vending machines, however, do not allow for variation in product size and can only vend the particular item for which they were designed. Additionally, typical vending machines may be inconsistent with the way that people currently purchase items; many people prefer to use credit or debit cards instead of cash. Many vending machines also occupy a great deal of space. Finally, typical vending machines do not employ any mechanism to prevent a purchaser from quickly dispensing all the items in the vending machine.

Because theft has become so rampant in certain product categories, such as razors and infant formula, many retail stores are taking the products off the shelves and placing them behind the counter or under lock and key. Customers must request the products to make a purchase. This requires additional labor costs to provide individual service to customers who would normally not require it. It also makes it difficult for customers to compare products. Furthermore, it may be impossible where the space behind the counter is limited and is needed for prescription medications. In some cases, products are simply unavailable due to high pilferage rates. Therefore, a device or dispensing apparatus that minimizes the incidence of product theft is needed.

A common problem at pharmacies and grocery stores is ensuring that consumers have access to cold medication, fragrances, or razors, but at the same time deterring theft or multiple purchases for the production of drugs. A solution to the problem of sweeping is to limit the amount of product each customer is allowed to purchase. However, this requires additional labor and is not feasible where many stores now allow customers the option to check themselves out without the help of a cashier. Furthermore, this solution also keeps lawful products out of the hands of lawful consumers. Finally, legislation may be required to limit such purchases. A device or dispensing apparatus that minimizes the likelihood of sweeping or unusually high numbers of multiple purchases is needed.

Such a device or dispensing apparatus should also be able to fit within common grocery, drug store or other retail environment shelves. It is also desirable that the device or dispensing apparatus effectively display the products so consumers can easily identify the products. It is also preferable that the dispensing apparatus be easy to use.

SUMMARY

Secure merchandising systems according to embodiments of this invention provide a system for dispensing product that deters theft of the product while also providing a dispensing system that is easy to use. Embodiments of this invention may include one or more dispensing modules, which generally include a door assembly, a lockout assembly, and house at least one pusher assembly. Dispensing modules of this invention are easily adjustable, so that they may easily be restocked and reconfigured.

Certain embodiments of systems of this invention may incorporate a time delay feature, which requires someone who wants to remove more than one product from a dispenser to wait several seconds between removal of each product. Certain systems of this invention may also include a lockout feature, so that only one pusher assembly may be activated to dispense a product at one time. In addition, some embodiments of this invention may include a door assembly, keyed locks, and other mechanisms that prevent access to the product storage portion of the system.

DETAILED DESCRIPTION

Embodiments of the invention now will be described more fully with reference to the drawings.

Secure merchandising systems of this invention may include one or more dispensing modules for dispensing products and for deterring theft of products. Secure merchandising systems of this invention may be configured so that only one product per dispensing module may be removed at a time and only when the product is at the front of the assembly. This requires someone who wants to remove more than one product from a dispensing module to wait several seconds between removal of each product, which has been found to be a substantial deterrence to product theft.

Figure 1:
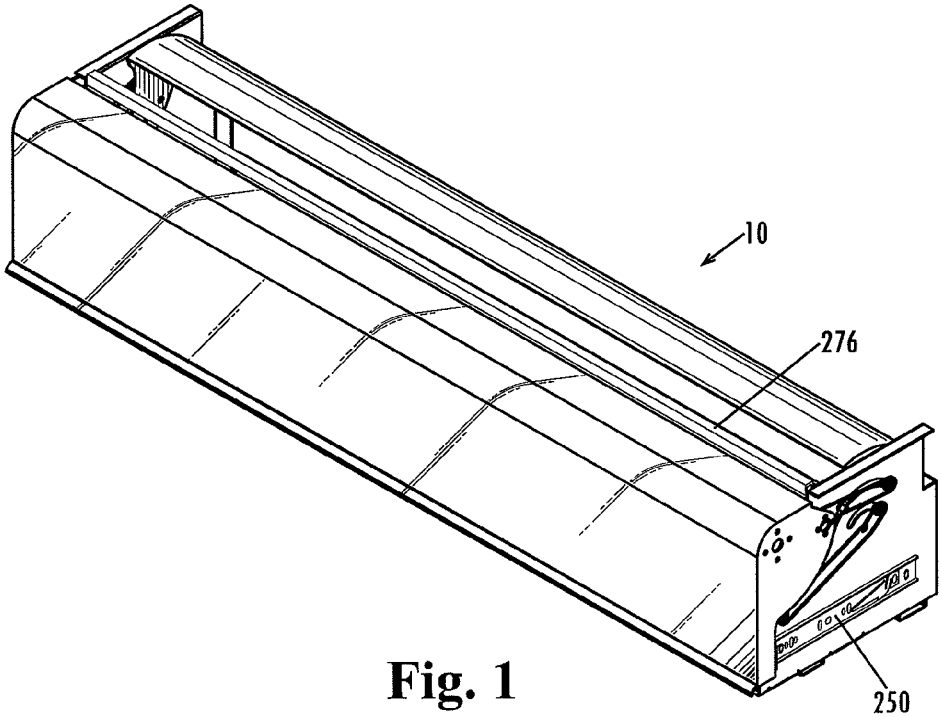
FIG. 1 is a front perspective view of a dispensing module assembly of a secure merchandising system according to certain embodiments of the invention.
Figure 2:
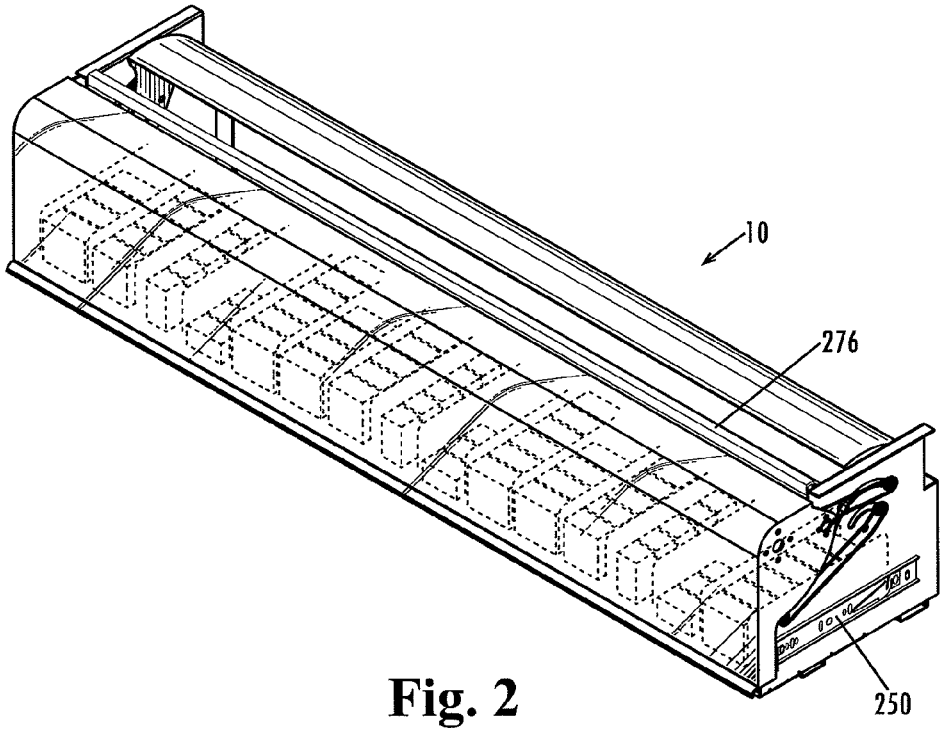
FIG. 2 is a front perspective view of the module assembly of FIG. 1, in a starting position before products, which are shown by broken lines, are dispensed.
Figure 36:
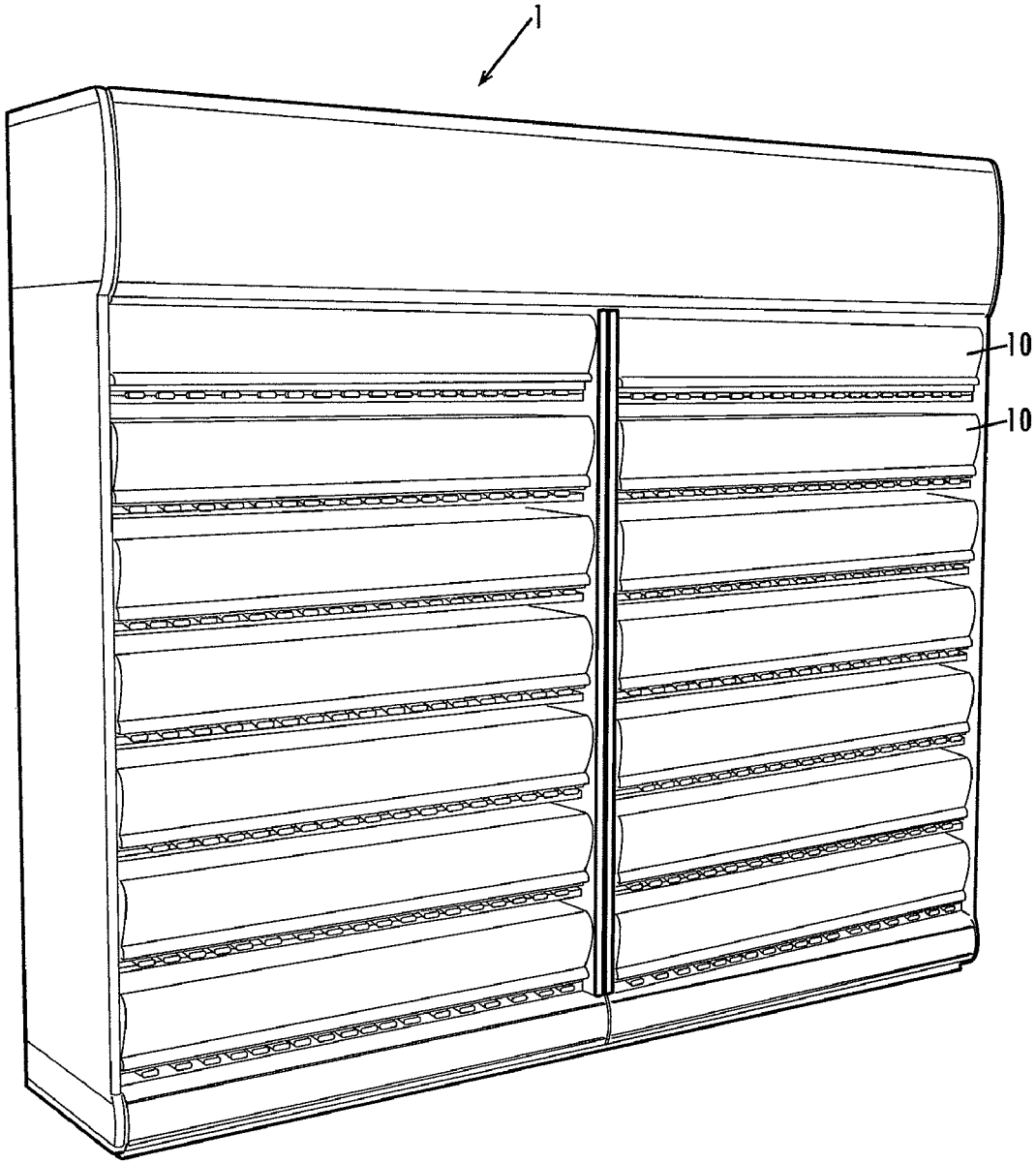
FIG. 36 is a front perspective view of a cabinet assembly in which a plurality of dispensing module assemblies of FIG. 1 are housed.

As shown in FIGS. 1-2, a secure merchandising system of this invention may include a dispensing module 10. The dispensing module may be pre-manufactured and pre-assembled. As shown in FIG. 36, the dispensing module 10 may be formed to fit into a cabinet assembly 1, and may be configured to slide in a drawer-like manner within the cabinet assembly 1. Alternatively, the dispensing module 10 may be formed as a "free standing" unit, or may be adapted to hang from existing standard shelving backs (such as a gondola) or a metal rack. In certain embodiments, a plurality of dispensing modules 10 can be arranged within a cabinet assembly 1 (shown in FIG. 36).

Figure 14:
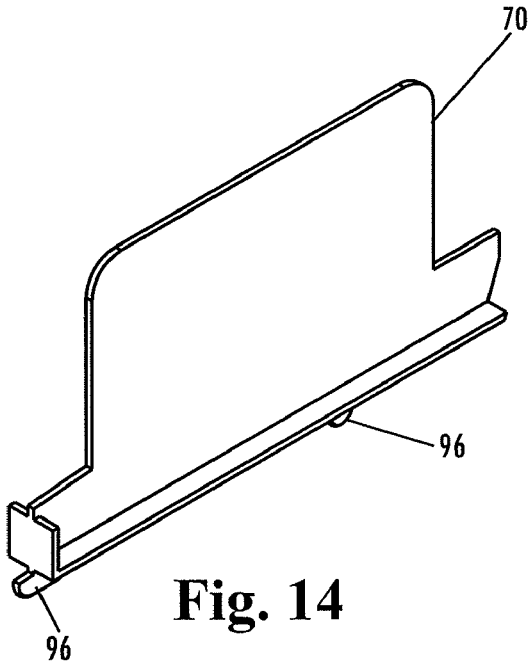
FIG. 14 is a perspective view of a divider of FIG. 1.

A single dispensing module 10 is shown in detail in FIGS. 1 to 7. Dispensing module 10 includes a lockout assembly 62 (shown in FIG. 8), a door assembly 64 (shown in FIG. 15), and a plurality of pusher assembly units 68 (shown in FIGS. 7 and 21-35), which are separated by dividers 70 (shown in FIGS. 7 and 14).

Figure 8:
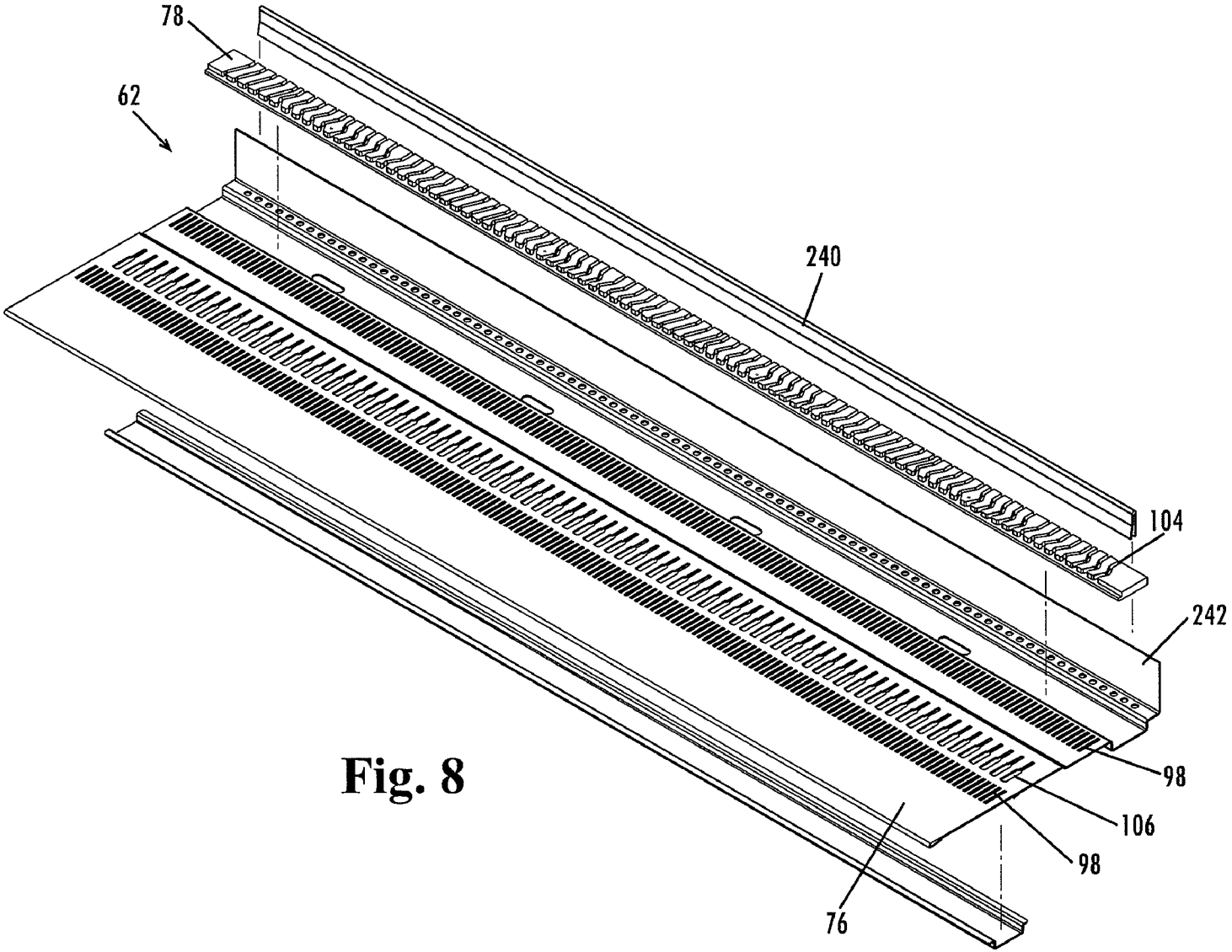
FIG. 8 is an exploded perspective view of the lockout assembly of FIG. 1.

As shown in exploded view in FIG. 8, lockout assembly 62 includes a front bottom member 76 and a slide lock member 78. Each slot 106 of front bottom member 76 is sized to receive an extended tab 108 (shown in FIG. 26) of a pusher assembly unit 68 (further described below). Each pusher assembly unit 68 includes a pin 100 (shown in FIGS. 23 and 26) that passes into channel 104 of the slide lock member 78. When the actuator 102 of a pusher unit 68 is depressed, the pin 100 moves toward the back of the dispensing module 10 in the channel 104. As shown in FIG. 8, channels 104 are shaped so that as the pin 100 is forced through the channel 104, the slide lock member 78 shifts to one side, blocking access to any other channels 104. Channels 104 vary in position and direction. Thus, only one pin 100 may be forced through any channel at a time. In this manner, only one pusher assembly unit 68 may be activated at a time.

A plurality of apertures 98 of front bottom member 76 trap extended tabs 96 on the divider 70 (shown in FIG. 14), securing the dividers 70 in position. A plurality of slots 106 of front bottom member 76 trap extended tabs 108 on the pusher assembly 68 (FIG. 26), securing the pusher assembly units 68 in position. The dispensing module may be easily reconfigured using the various slots 106 to accommodate a variety of sizes and quantities of pusher assembly units. Moreover, the dispensing module 10 also may be easily reconfigured using the various apertures 98 to accommodate a variety of sizes of product by repositioning the dividers 70. This ensures that the optimum amount of shelf space is utilized, providing maximum density and profitability to the retailer. A hinged panel 240 is located on the rear panel 242 of the dispensing module, shown in FIG. 8. Hinged panel 240 has a flange that rotates around rear panel 242 to contact the dividers 70 and pusher assemblies 68 so that when hinged panel lays against the inside of rear panel 242, the dividers 70 and pusher assemblies 68 must be lifted in order to be removed. In this way, the hinged panel 240 locks the dividers 70 into position.

Figure 12:
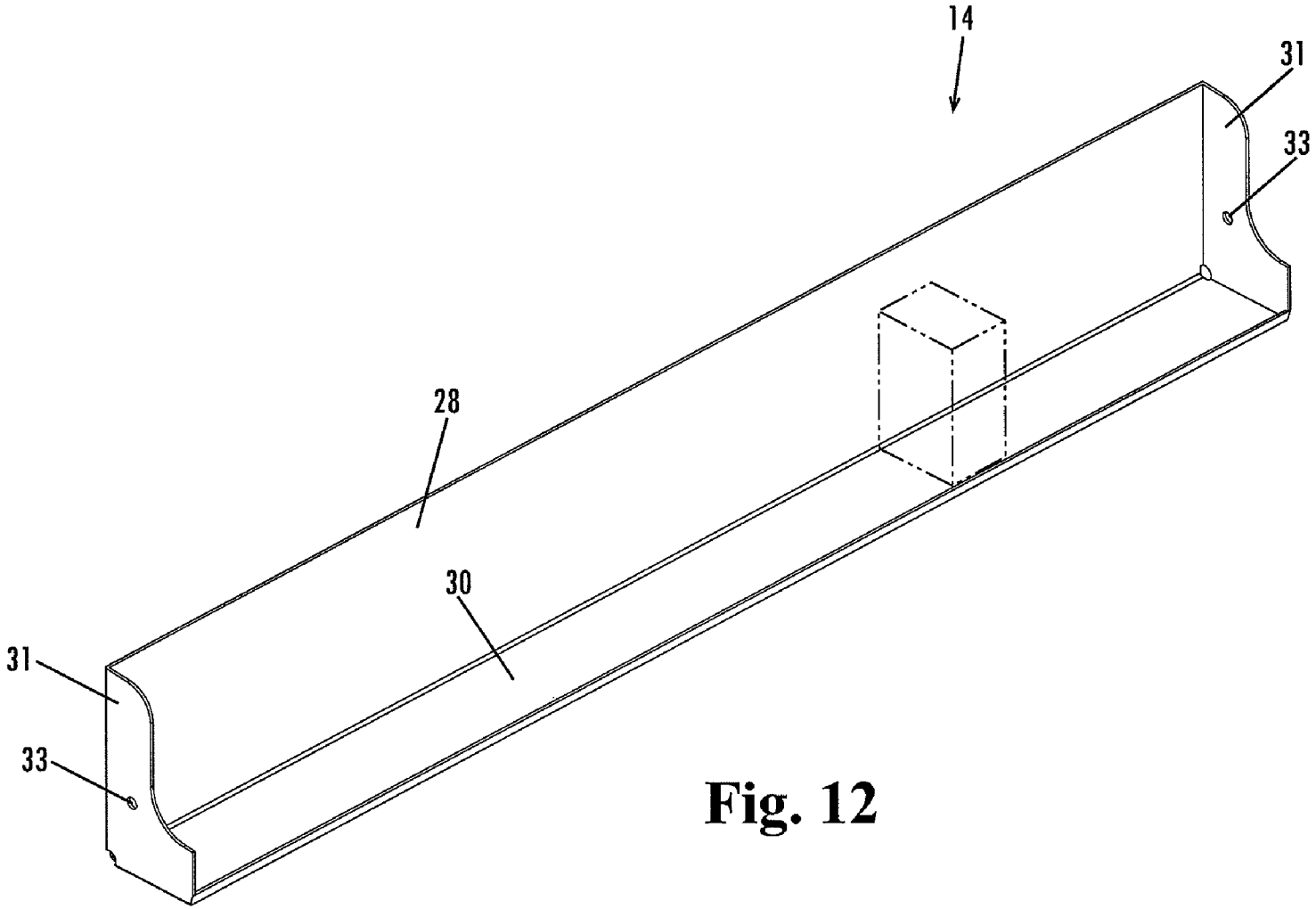
FIG. 12 is a rear perspective view of the tray of FIG. 10.
Figure 15:
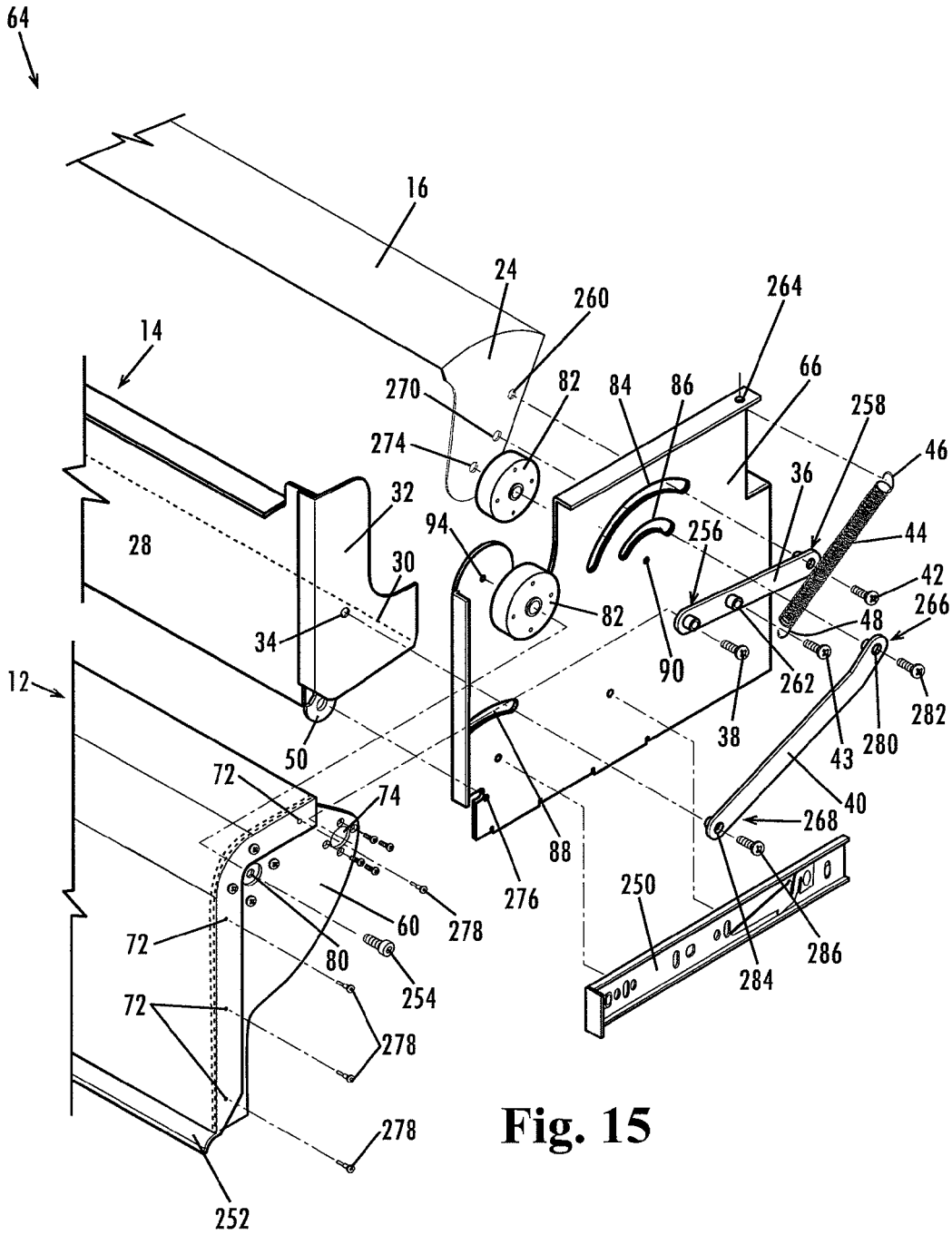
FIG. 15 is a partial exploded perspective view of the door assembly of FIG. 1.
Figure 16:
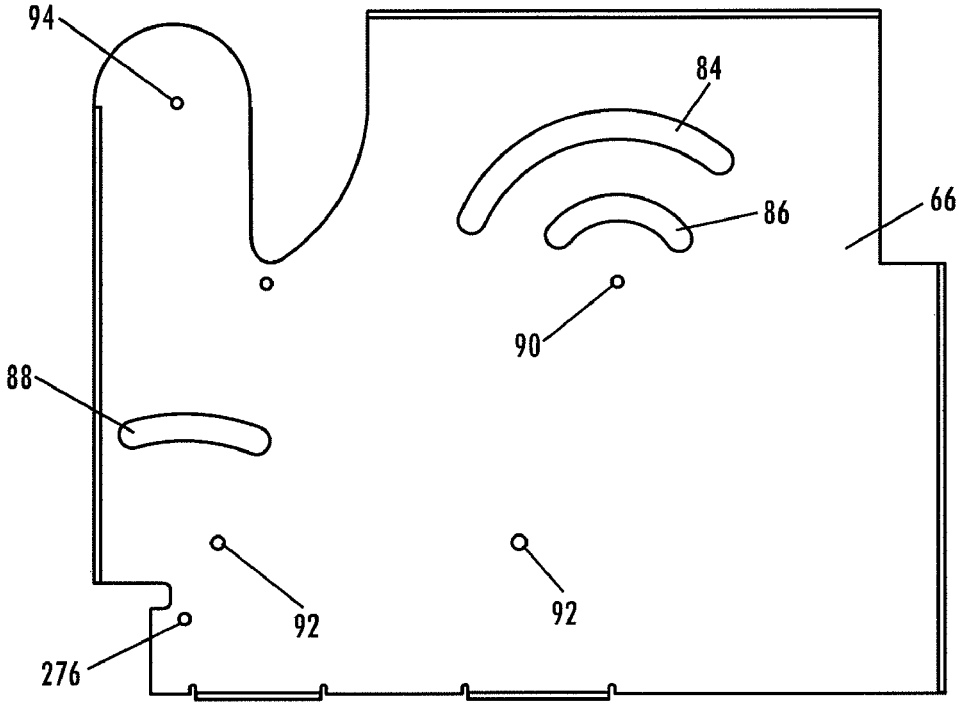
FIG. 16 is an end view of the side panel of FIG. 1.
Figure 17:
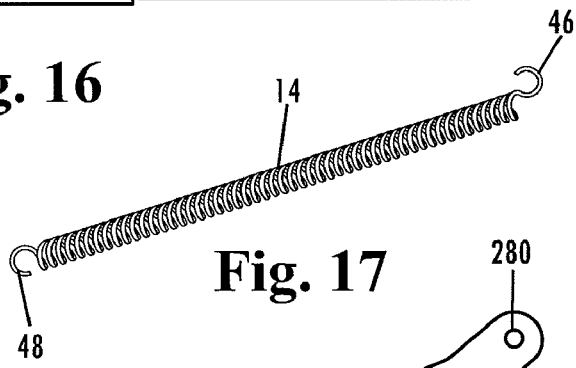
FIG. 17 is a perspective view of a spring of FIGS. 5-6.

Door assembly 64, shown in partial exploded view in FIG. 15, includes a front panel 12 (shown in FIG. 9), a tray 14 having two ends 32 (shown in FIGS. 10-12), a top panel 16 having two ends 24 (shown in FIGS. 7 and 15), and two side panels 66 (shown in FIGS. 5-6 and 15-16). In one embodiment, at least front panel 12 and tray 14 are clear, so that the encased products can be easily viewed by purchasers. According to certain embodiments, some components are constructed of a clear plastic or other material to allow viewing of the product and to take advantage of its lightweight, yet shatterproof properties. In one such embodiment, the components are made of polycarbonate.

Figure 18:
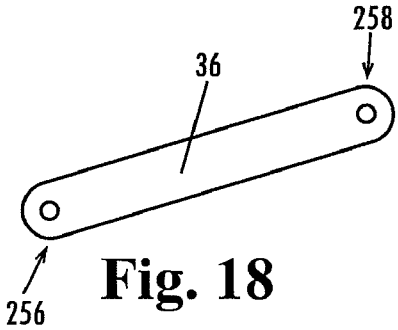
FIG. 18 is a plan view of a door arm of FIG. 1.
Figure 19:
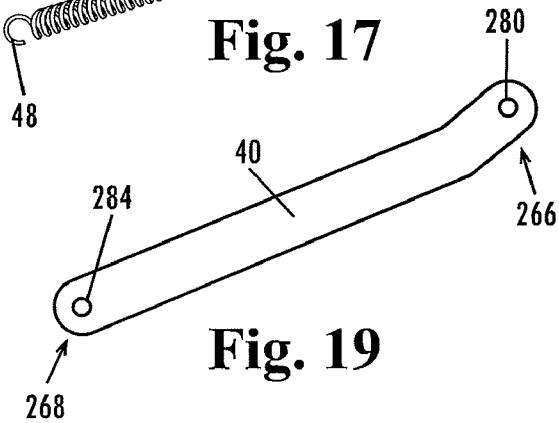
FIG. 19 is a plan view of a link arm of FIG. 1.
Figure 20:
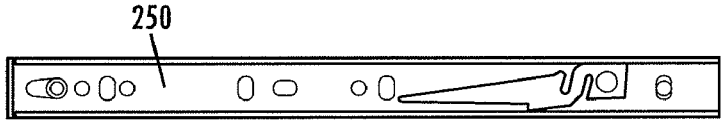
FIG. 20 is a plan view of a slide component of FIG. 1.

In some embodiments, each side panel 66, shown in FIGS. 5-6 and 15-16, is perforated by a curved opening 84, which receives a door arm 36, further described below and shown in FIG. 18. Each side panel 66 is also perforated by a curved opening 86, which receives a link arm 40, further described below and shown in FIG. 19. Each side panel 66 is further perforated by a curved opening 88, which receives a fastener that attaches the side panel 66 to tray 14, further explained below. As used throughout this specification, "fastener" could be a screw, blind rivet, or any other suitable fastener. Each side panel 66 also may include two openings 92 (shown in FIG. 7), each of which receives a fastener to attach a slide assembly component 250 (shown in FIGS. 1-2, 5-6, 7, 15, and 20) to the side panel 66. Each side panel 66 also includes an opening 94, which receives a fastener, such as, but not limited to, screw 254 (shown in FIGS. 7 and 15), to attach the side panel 66 to a side plate 60.

Figures 10, 11:
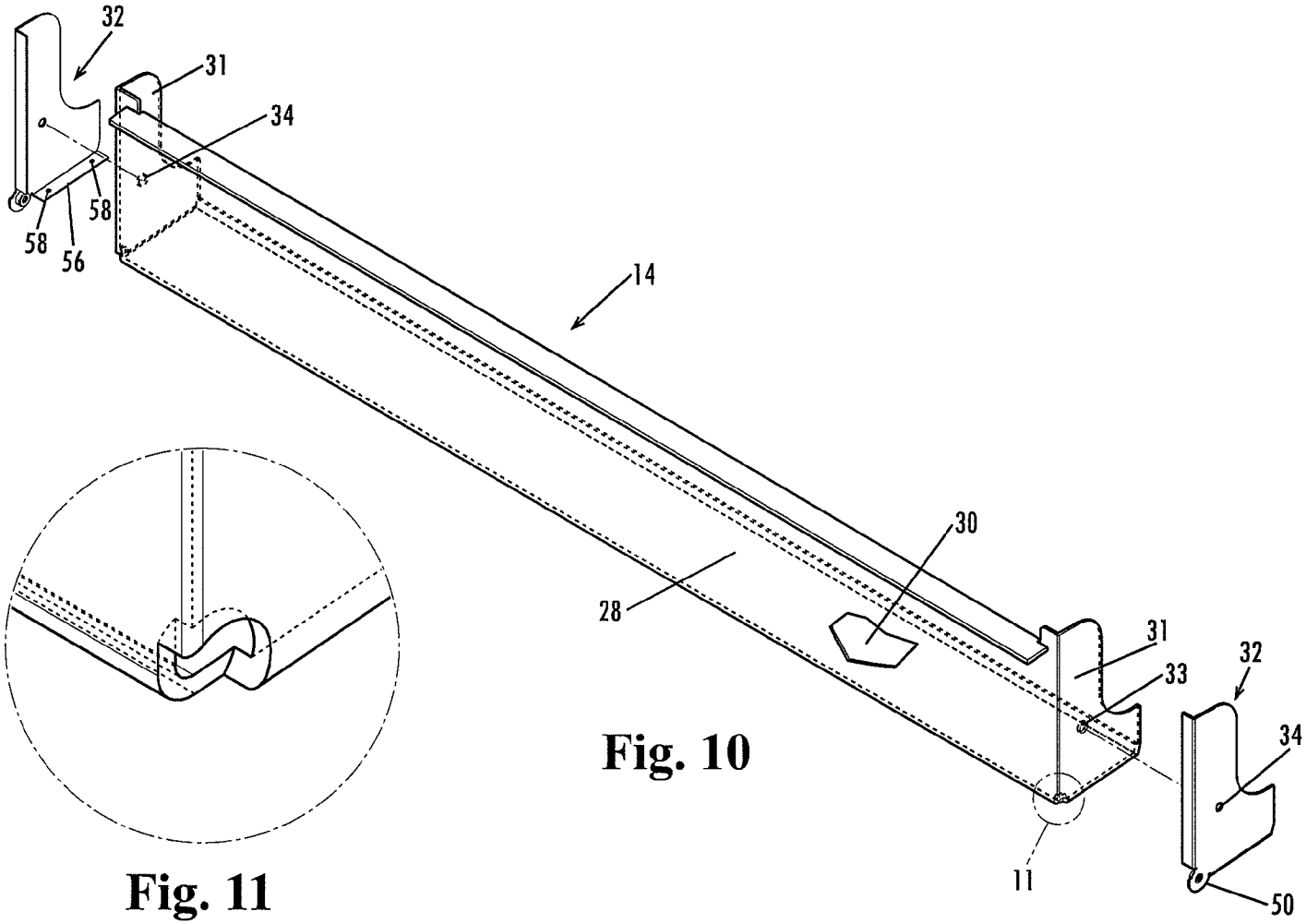
FIG. 10 is an exploded perspective view of the tray of FIG. 1.
FIG. 11 is an enlarged detail view of a portion of the tray of FIG. 10.

As illustrated in FIGS. 7 and 10-12, tray 14 includes a front 28, a bottom 30, and sides 31. Sides 31 each have an opening 33. Tray 14 is attached at opening 33 using any suitable fastener to ends 32 at opening 34. As shown in FIG. 10, ends 32 include a bar 56 having openings 58, the bar serving to mount the ends 32 to the tray 14. Any suitable fastener, such as a screw, may be received in openings 58 to attach ends 32 to tray 14.

Figure 6:
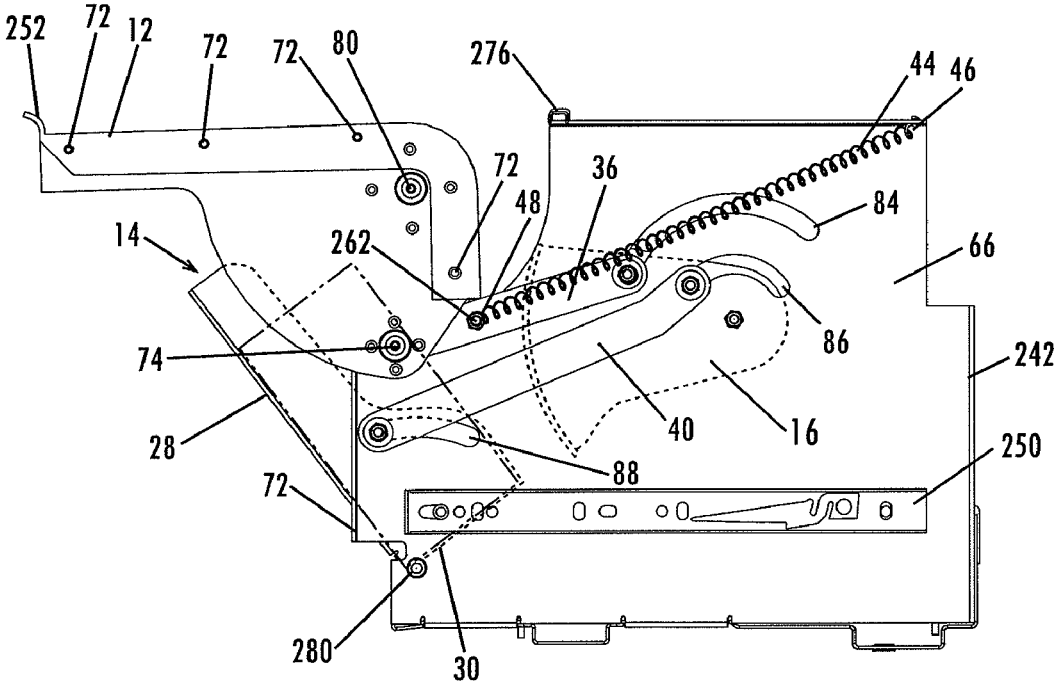
FIG. 6 is an end view of the module assembly of FIG. 1, shown in the open position.
Figure 7:
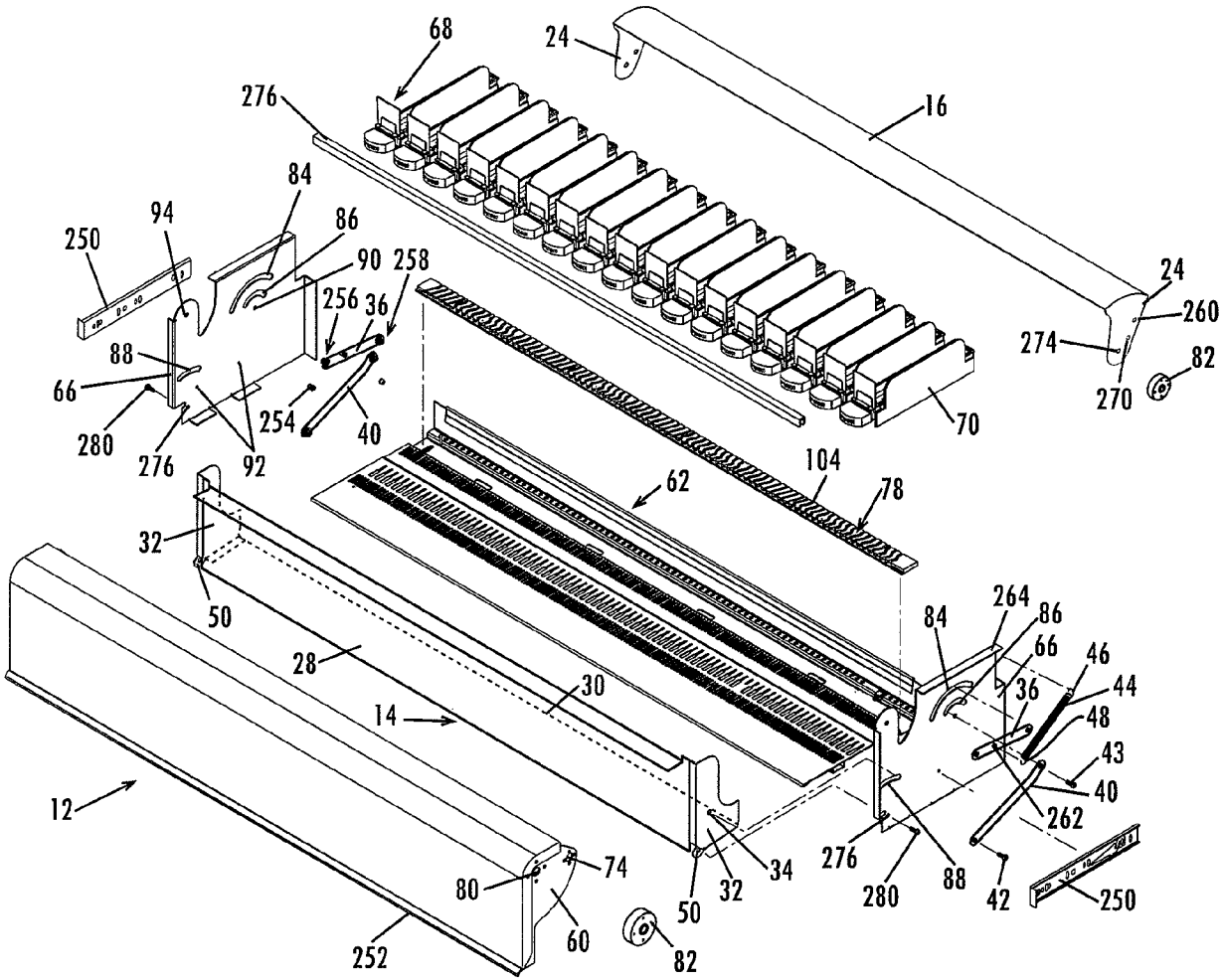
FIG. 7 is an exploded view of the module assembly of FIG. 1.

As shown in FIG. 10, each end 32 also includes a pivot 50 that is attached to side panel 66 using any suitable fastener (such as, but not limited to, screw 280 shown in FIGS. 6-7), which is received in opening 276 (shown in FIG. 7). Pivot 50 allows tray 14 to rotate about a fixed point on side panel 66 when the door assembly 64 moves between an open position and a closed position. When door assembly 64 is in the closed position, tray 14 is in a substantially upright position and the bottom 30 of tray 14 is substantially flat and can receive product. In this way, the product rests on bottom 30 of the tray 14 when the door assembly 64 is in a closed position. When the door assembly 64 is in an open position, tray 14 rotates about pivot 50 from one end of the curved opening 88 (explained in detail below) to the other end of curved opening 88 so that the tray 14 is positioned at an angle. Thus, bottom 30 of tray 14 is also positioned at an angle. Because bottom 30 is tilted toward the front 28, gravity causes any product that was positioned on bottom 30 to move forward toward the front 28 of tray 14. The product can then be retrieved by a purchaser.

Figure 9:
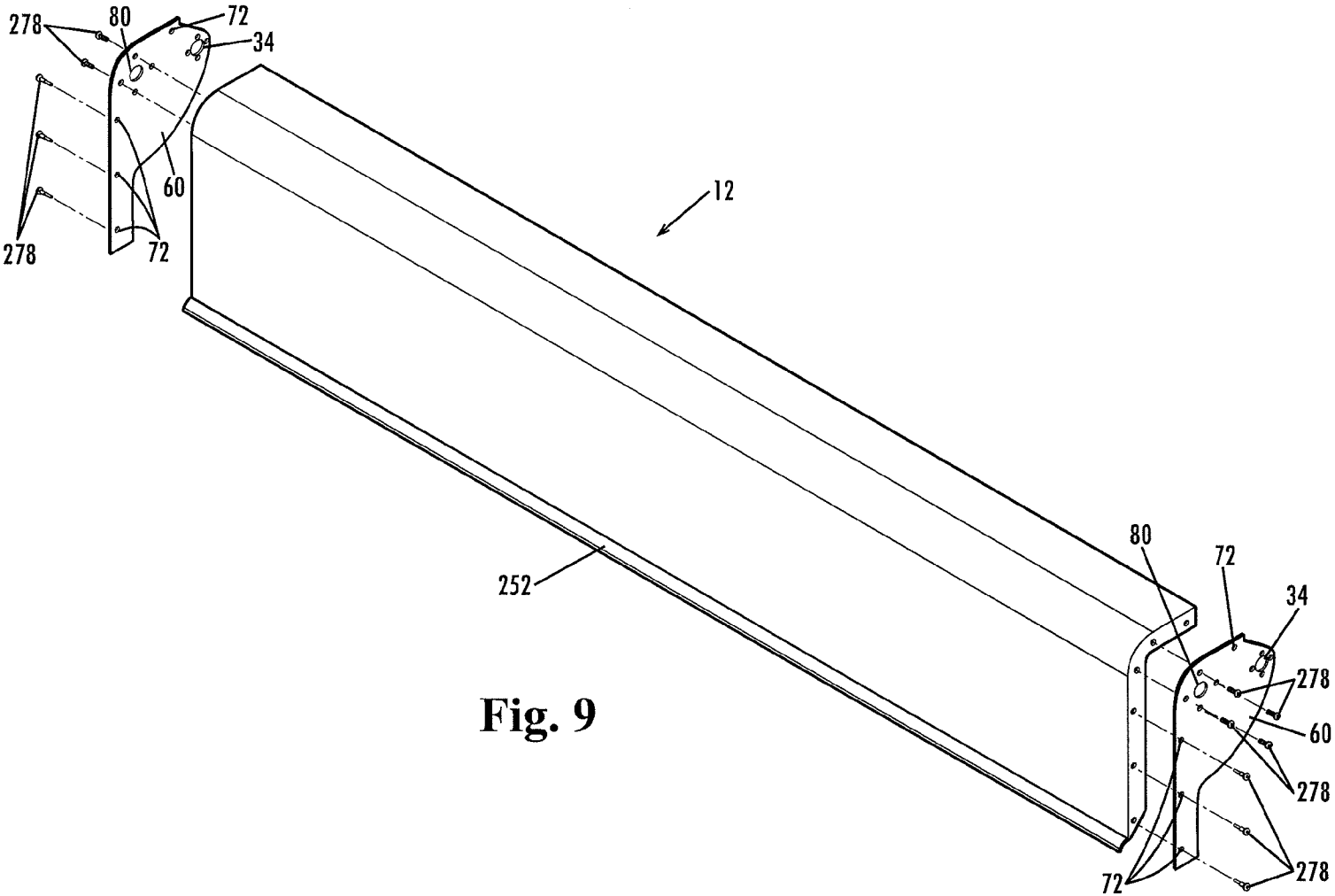
FIG. 9 is a partially exploded perspective view of the front panel of FIG. 1.

Door assembly 64 also includes two side plates 60, shown in FIGS. 5-7, 9, and 15, which each include a plurality of openings 72, as well as an attachment site 80 and an attachment site 74. In some embodiments, front panel 12 may be curved in a generally L-shape so that when door assembly 64 is in a closed position, front panel 12 closes front access to product housed within the dispensing module 10. Front panel 12 includes a lip 252, which a purchaser can use to open and close the door assembly 64. As shown in FIGS. 9 and 15, each end of front panel 12 may be attached to side plate 60 using any suitable fastener, such as, but not limited to, screw 278. Specifically, side plate 60 includes openings 72, which receive any suitable fastener, such as screw 278, to attach front panel 12 to each side plate 60.

As mentioned above, side plate 60 may also include an attachment site 80, which receives any suitable fastener, such as, but not limited to, screw 254 (shown in FIGS. 7 and 15), to attach side plate 60 to side panel 66 at opening 94. In some embodiments, a spacer 82 may placed between side plate 60 and side panel 66 to allow the door assembly 64 to open and close without obstruction.

Figure 5:
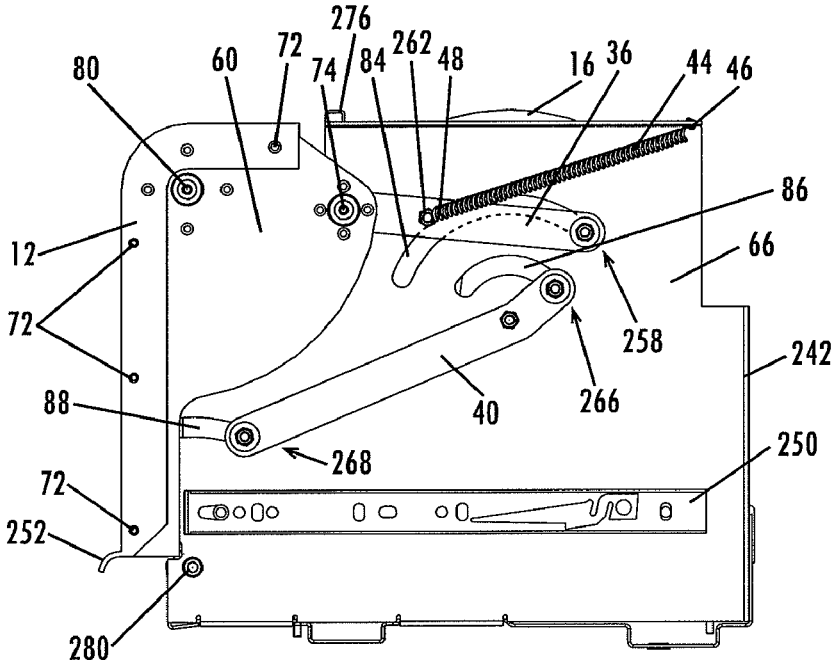
FIG. 5 is an end view of the module assembly of FIG. 1, shown in the closed position.

As shown in FIGS. 5-6 and 15, door arm 36 (also shown in FIG. 18) links movement between the top panel 16 and the front panel 12, the front panel 12 being attached to side plates 60 as explained above. A first end 256 of door arm 36 may be attached to each side plate 60 at a second attachment site 74 on side plate 60, which receives any suitable fastener, such as, but not limited to, screw 38 (shown in FIG. 15).

Door arm 36 has a second end 258 that attaches to an end 24 of top panel 16 using any suitable fastener, such as, but not limited to, screw 42 (shown in FIG. 15). In one embodiment, a fastener (such as screw 42) passes through the curved opening 84 of side panel 66 to attach second end 258 of door arm 36 to end 24 of top panel 16 at opening 260 on end 24. Door arm 36 moves from one end of curved opening 84 to the other end of curved opening 84 as the door assembly 64 opens and closes.

Door spring 44 (shown in FIGS. 5-6, 15, and 17) urges the door assembly to a closed position. End 48 of door spring 44 may be attached to door arm 36 at attachment site 262. For example, end 48 of door spring 44 may wrap around attachment site 262. A hook 46 of door spring 44 may hook through opening 264 on the top of side panel 66, as shown in FIGS. 5-6. In one embodiment, door assembly may include a damper to prevent the front panel 12 from slamming shut. As an example, a gear rotating with door assembly 64 could slow down the closing of the front panel 12 by interacting with a damper with a pinion gear.

As shown in FIGS. 5-6 and 15, dispensing module 10 may further include a link arm 40 (also shown in FIG. 19), which links movement between the top panel 16 and the tray 14. Specifically, a first end 266 of link arm 40 includes an opening 280 through which any suitable fastener (such as, but not limited to, screw 282) may pass. Screw 282 also passes through curved opening 86 of side panel 66 and through opening 270 of end 24 of top panel 16, thereby attaching link arm 40 to the top panel 16. A second end 268 of link arm 40 is attached to the end 32 of tray 14. Specifically, second end 268 of link arm 40 includes an opening 284, through which any suitable fastener (such as screw 286) may pass. Screw 286 then passes through curved opening 88 of the side panel 66, and through opening 34 of end 32 of tray 14, thereby attaching link arm 40 to tray 14. First end 266 of link arm 40 moves from one end of curved opening 86 to the other end of curved opening 86 as the door assembly 64 opens and closes, and second end 268 of link arm 40 moves from one end of opening 88 to the other end of curved opening 88 as the door assembly 64 opens and closes. Thus, as the door assembly 64 is opened and closed, the link arm 40 moves until it reaches the end point of opening 88. In this manner, one end of the opening 88 functions as a stop preventing the front panel 12 from being fully extended in an upward direction.

As shown in FIGS. 7 and 15, end 24 of top panel 16 may also include another opening 274, through which any suitable fastener, such as, but not limited to, screw 43, may pass to attach the end 24 of top panel 16 to aperture 90 of the side panel 66. In some embodiments, a spacer 82 may be positioned between end 24 and side panel 66 to allow the door assembly 64 to open and close without obstruction.

In some embodiments and as illustrated in FIGS. 1-2, dispensing module 10 may optionally include a bar 276 that extends from one end of the dispensing module to another. The bar 276 may be welded, or otherwise attached, to each side panel 66 to provide strength and support to the dispensing module 10.

When the front panel 12 is opened to move the door assembly 64 into an open position, the front panel 12 is lifted as the top panel 16 moves in a downward direction to block access to additional product stored within the dispensing module 10. As the door assembly 64 moves to an open position, the tray 14 rotates forward to an angled position, as explained above, to allow a user to access any dispensed product. The curved openings 84, 86, and 88 are sized and shaped to allow the various components to move in coordination together so that as the front panel 12 is opened and the tray 14 rotates forward, the top panel 16 moves downward and is positioned relative to the front panel 12 to block access to additional product stored within the dispensing module and not dispensed into tray 14. In some embodiments, the top panel 16 is metal or any suitable material that supports the door assembly 64 and serves as a counterweight to urge the door assembly 64 from an open position to a closed position. Door spring 44 discussed above also acts as a counterweight as the door assembly 64 moves from an open position to a closed position.

Figure 37:
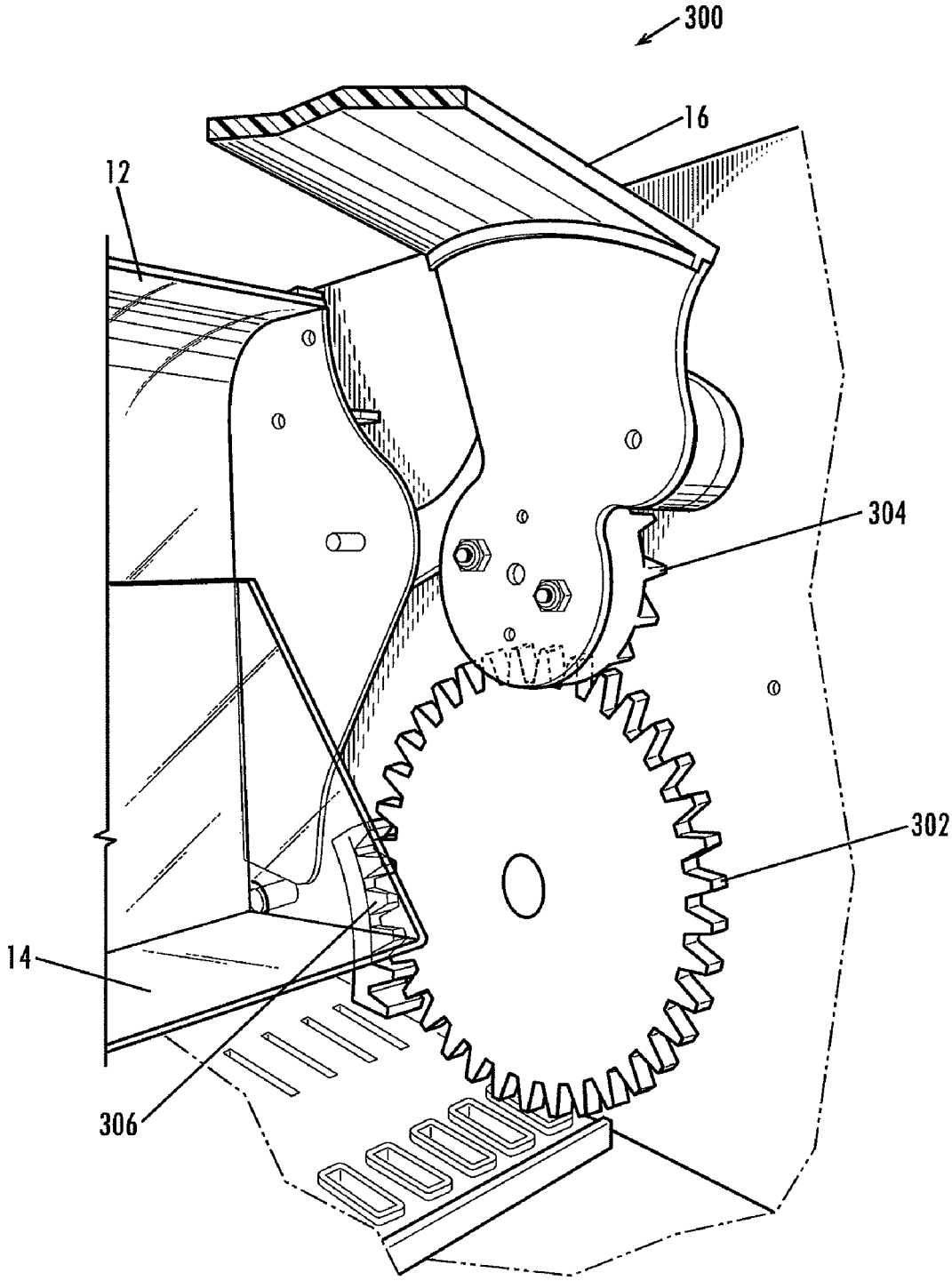
FIG. 37 is a partial perspective view of a door assembly of a dispensing module assembly according to an alternate embodiment of the invention.

In other embodiments, the dispensing module may include a door assembly 300 having gears, such as, but not limited to, pinion gears, instead of or in addition to the door and link arms described above. For example, as shown in FIG. 37, gears 302, 304, and 306 may interact with one another to couple the movement of the top panel 16, the front panel 12, and the tray 14 so that as the front panel 12 is opened, the tray 14 rotates toward the front of the dispensing module and the top panel 16 also rotates so that the top panel 16 blocks access to any product stored inside the dispensing module. Alternatively, any other suitable mechanism may be used to couple the movement of the top panel 16, the front panel 12, and the tray 14.

Figure 3:
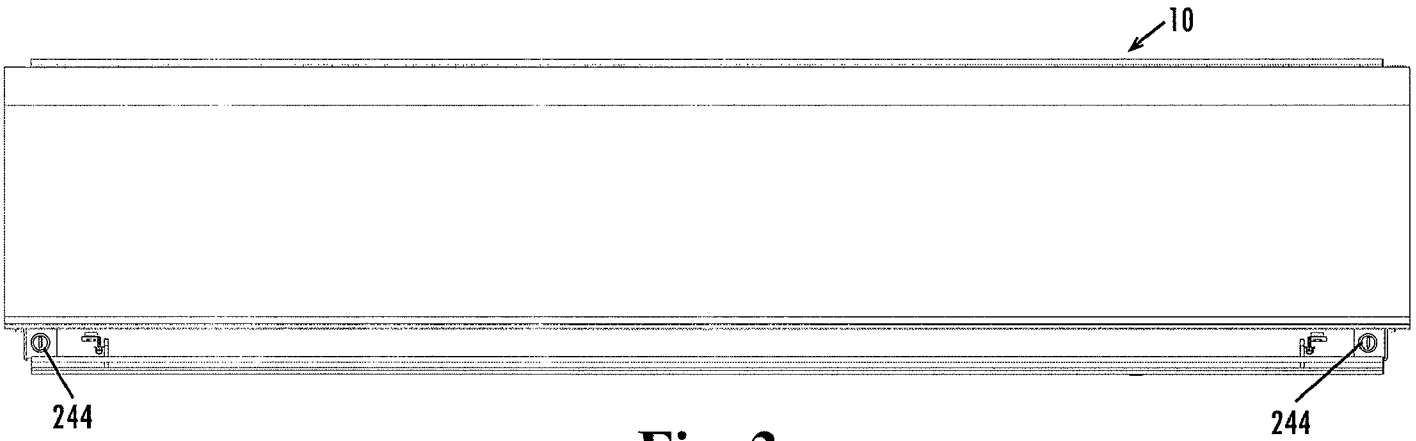
FIG. 3 is a front view of the module assembly of FIG. 1.
Figure 4:
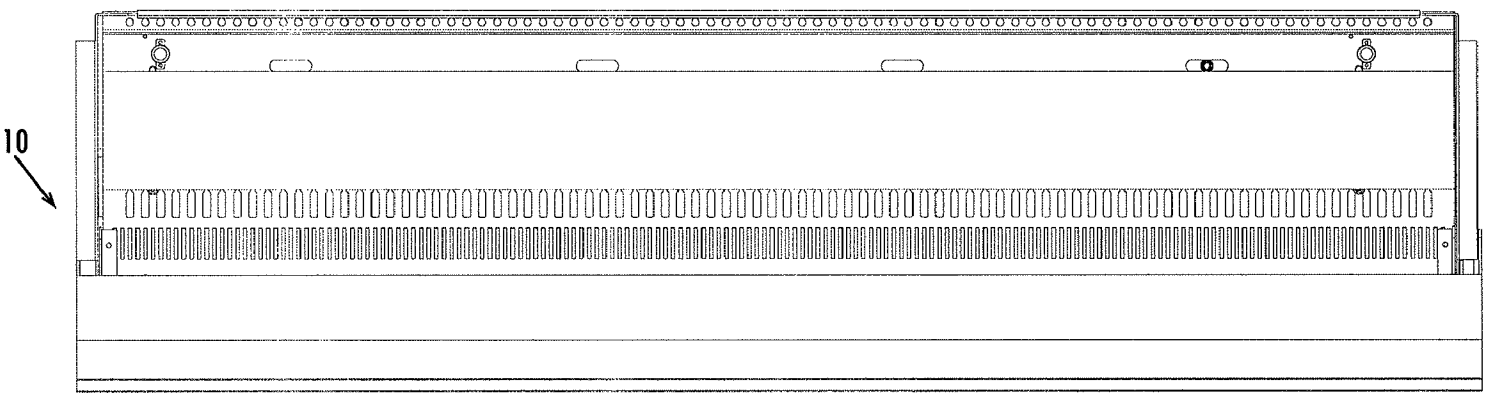
FIG. 4 is a top view of the module assembly of FIG. 1.
Figure 13:
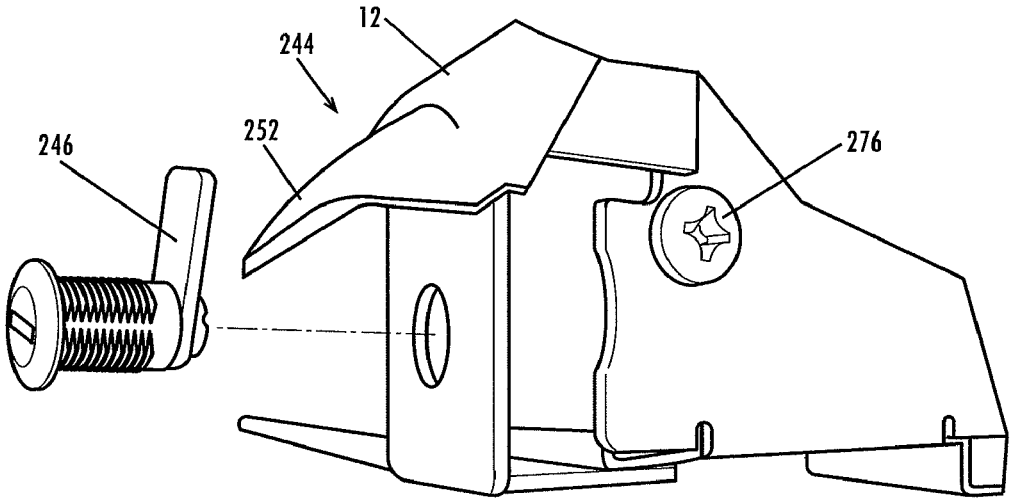
FIG. 13 is a perspective view of the lock of FIG. 3.

Certain embodiments of the theft deterrent system of this invention may be easily reconfigured and/or restocked by unlocking the front panel 12 of the door assembly 64. Keyed locks 244 (shown in FIG. 13) may be mounted in front panel 12, as shown in FIG. 3. When in a locked position, arm 246 of lock 244 may engage a slot (not shown) located on a cabinet assembly in which the dispensing unit may be housed. In this way, when in a locked position, the dispensing module 10 cannot be removed from the cabinet assembly.

Slide assembly components 250, shown in FIGS. 1-2, 5-6, 15, and 20, provide the unit with a "drawer-like" capability. Slide assembly components 250 may be attached to the outside of side panel members 66 using any suitable fastener. In some embodiments, slide assembly component can be a conventional slide mechanism that interacts with a drawer runner located on the inside of a cabinet assembly. Thus, dispensing module may slide in and out of a cabinet (such as the cabinet assembly 1 shown in FIG. 36) in which it may be housed.

Figure 21:
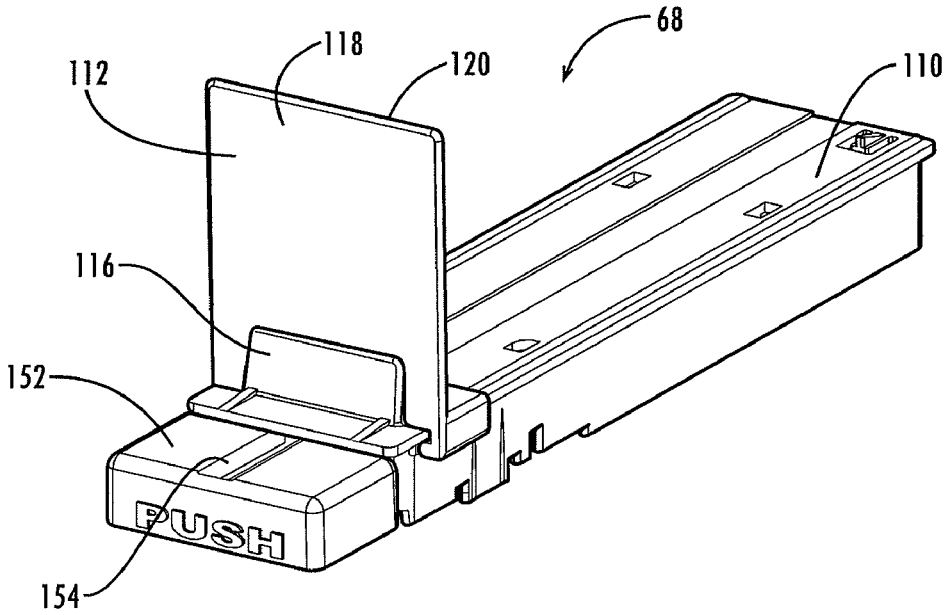
FIG. 21 is a perspective view of a pusher assembly of FIG. 1.

Within each dispensing module 10 is at least one pusher assembly unit 68 for advancing product, shown in FIGS. 21 to 35. As shown in FIG. 21, the pusher assembly 68 includes a track 110 on which products are placed. The products are held in place and pushed forward by a pushing ram 112, which is held in tension by a spring 114 (FIGS. 22-23), which may be a constant force spring in some embodiments. The pushing ram 112 keeps the next product to be dispensed against lip 116. Thus, as a first product is removed from the dispensing module, the products located behind the one that was removed must move forward.

Figure 24:
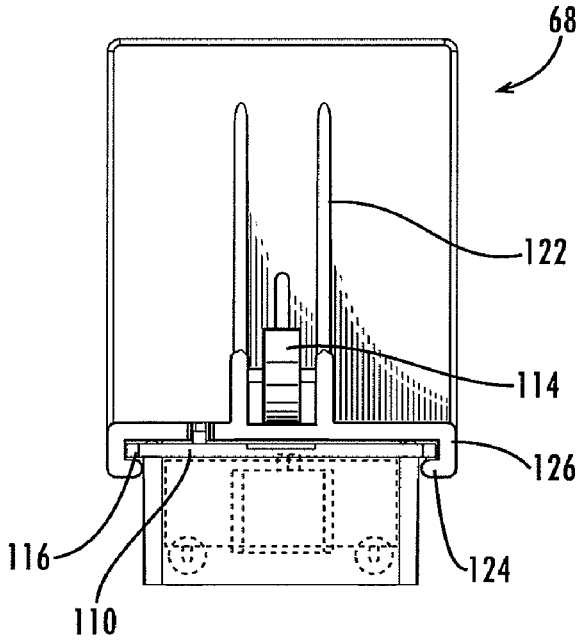
FIG. 24 is an end view of the pusher assembly of FIG. 21.

Pushing ram 112 includes a front surface 118 for engaging product and a rear surface 120. According to some embodiments, the pushing ram 112 is rectangular plate, although other suitable shapes and geometries may also be used. Pushing ram 112 includes gusset 122 (shown in FIG. 24), reinforcing pushing ram 112 and providing a housing for spring 114 (further described below). As shown in FIG. 24, extension 124 extends beyond the bottom portion 126 of pushing ram 112. In this manner, extension 124 engages track 110, so that pushing ram 112 is in sliding engagement with track 110.

Figure 22:
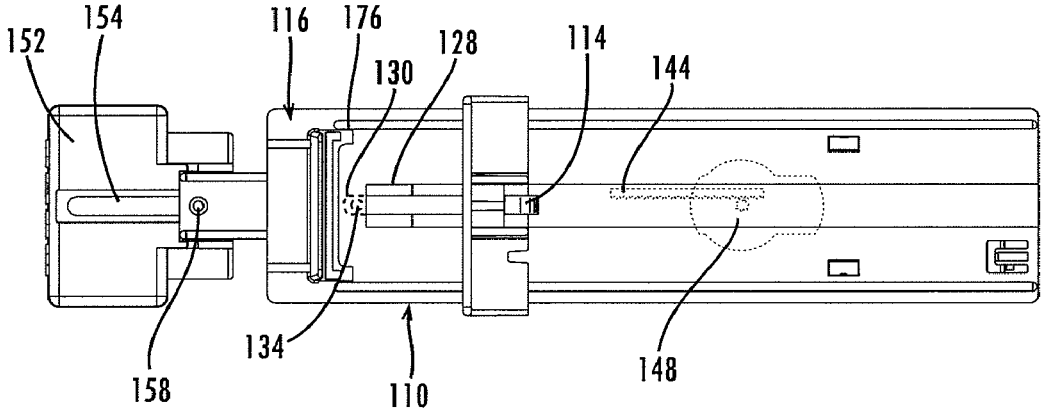
FIG. 22 is a top view of the pusher assembly of FIG. 21.

As shown in FIG. 22, spring 114 extends under the pushing ram 112, along track 110, and passes through front opening 128 in the track 110. End 130 of spring 114 includes aperture 132 that engages post 134 that projects downward from the bottom surface of the track 110. Spring 114 may also be attached to pusher assembly unit 68 in any other suitable manner. Movement of the pushing ram 112 toward the rear of the track 110 unwinds spring 114 so that spring 114 urges pushing ram 112 in the forward direction. The spring may preferably be a constant force spring, such as those sold under the trademark Conforce®, but many other types of springs, such as a variable force spring, may also be used. In certain embodiments, the spring is a stainless steel VULCAN PN# GP5D13AD spring that is 0.0050 inches thick by 0.250 inches wide by 13 inches long. The minimum force is 0.32 pounds and the maximum force is 0.80 pounds. Any other suitable spring may also be used.

Products can be loaded in pushing assembly unit 68 by forcing pushing ram 112 backwards along track 110 and placing multiple units of the product against the pushing ram 112. As described above, spring 114 causes the pushing ram 112 to exert force on the products towards the front of the track 110.

Figure 23:
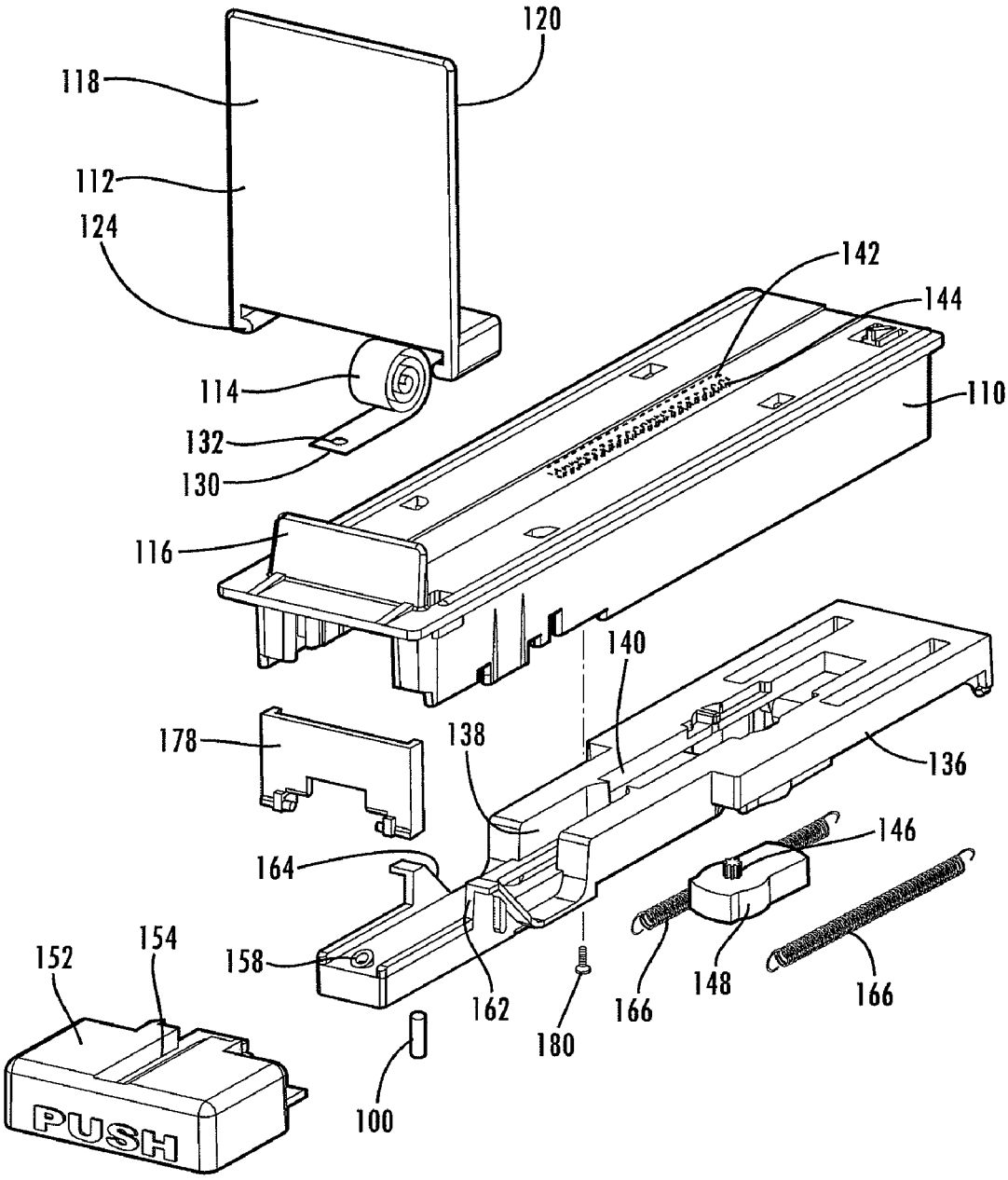
FIG. 23 is an exploded perspective view of the pusher assembly of FIG. 21.
Figure 26:
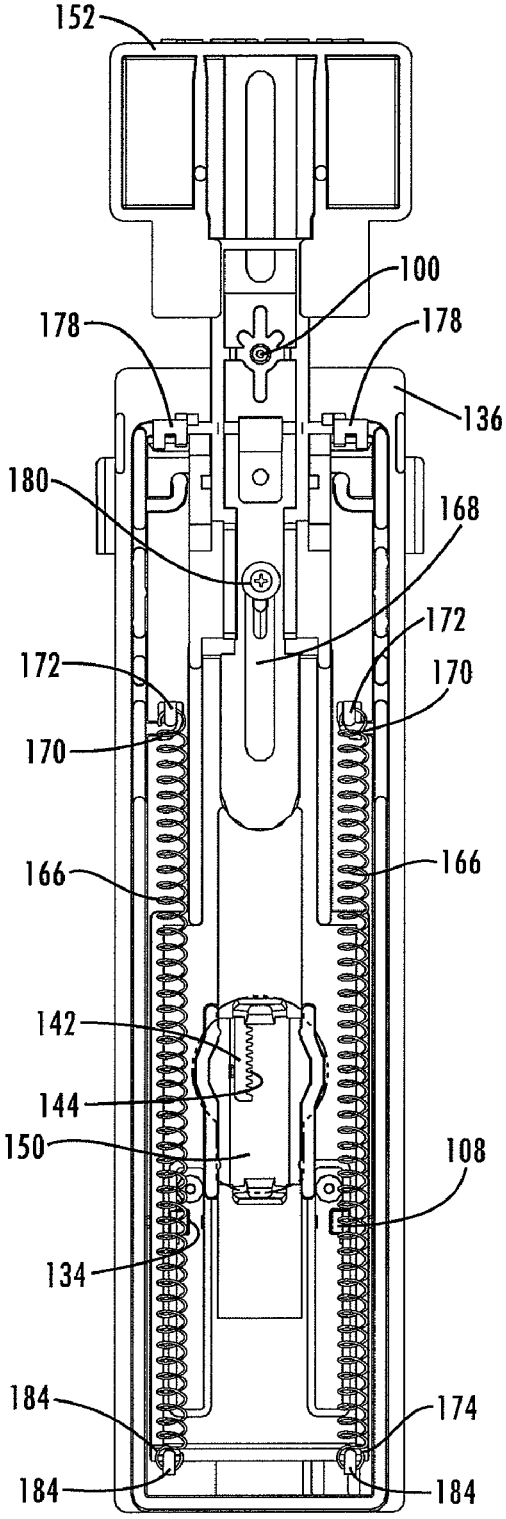
FIG. 26 is a bottom view of the pusher assembly of FIG. 21, shown without the resistance mechanism.

As shown in FIGS. 23 and 26, a lifter slide 136 may include a central channel 138 having side walls 140. A gear rack 142 having exposed gear teeth 144 is attached to one of side walls 140 along central channel 138 so that gear teeth 144 project into channel 138 and engage external gear 146 of the resistance mechanism 148, as further described below. It should be understood that the gear teeth may be positioned in various other manners along the track 110 or lifter slide 136 and maintain the functionality of the pushing assembly.

Figure 27:
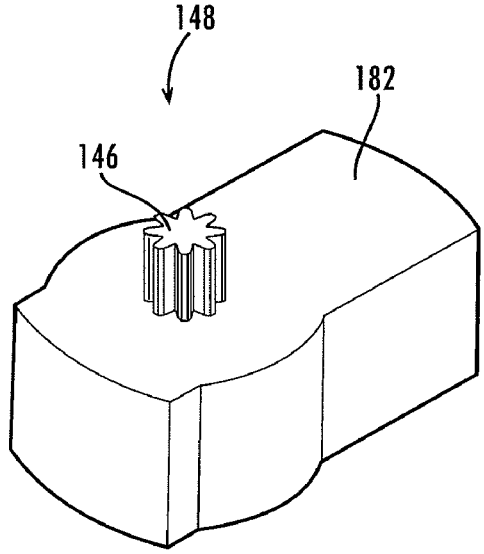
FIG. 27 is a perspective view of the resistance mechanism of the pusher assembly of FIG. 21.
Figure 28:
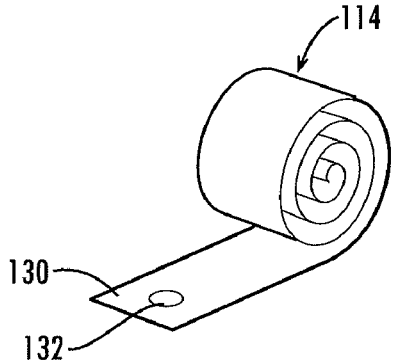
FIG. 28 is a perspective view of the spring of FIG. 21.

As shown in FIGS. 23 and 26-27, resistance mechanism 148 may be housed in cavity 150 on the bottom side of lifter slide 136. Resistance mechanism 148 includes a housing 182 and an external gear 146 (FIGS. 23 and 27) and is positioned in cavity 150 (FIG. 26) so that external gear 146 extends into channel 138 of lifter slide 136 and engages gear teeth 144. Resistance mechanism 148 works to slow down the forward movement of the pushing ram 112. According to certain embodiments, one such resistance mechanism is an interference or resistance motor, such as the resistance motor Model #w217 sold by Vigor, although other types of mechanisms that generate resistance may be used. For example, a rotary damper could also be used to slow the forward movement of the pushing ram 112.

Figure 25:
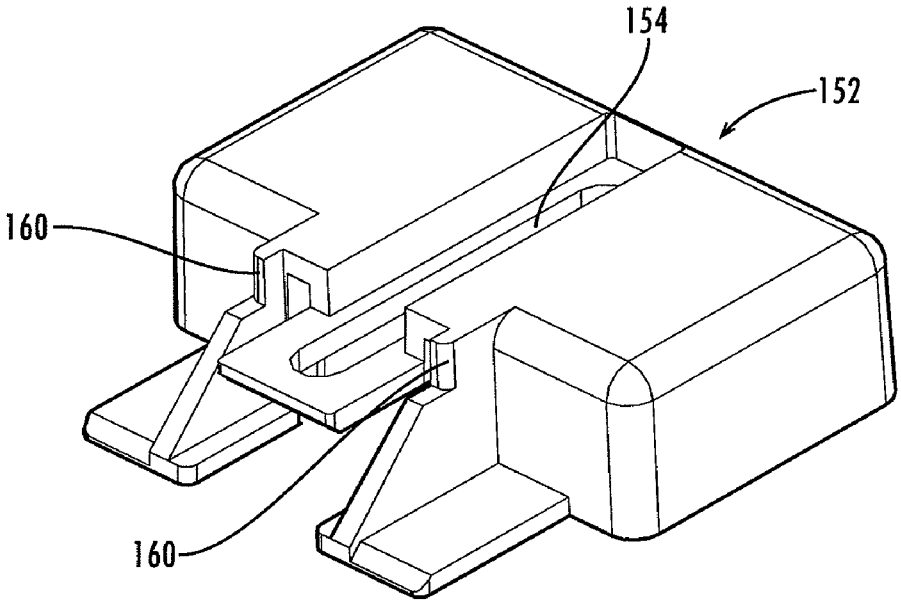
FIG. 25 is a perspective view of the button of FIG. 21.

Each pusher assembly unit 68 includes a product dispensing actuator, such as a button, lever or knob. According to certain embodiments and as shown in FIGS. 23 and 25-26, the actuator is a mechanical button 152. A user pushes the button 152 to release a product. Button 152 includes slot 154 through which a post and snap member 158 of lifter slide 136, or any other suitable attachment mechanism, passes. In this manner, button 152 is connected to lifter slide 136 and button 152 slides freely along the length of the slot 154.

When button 152 is depressed and thereby moved in a rearward direction, stop 160 (FIG. 25) of button 152 contacts the forward edge 162 of ramp 164 of lifter slide 136, pushing lifter slide 136 in a rearward direction. As shown in FIG. 26, lifter slide 136 is perforated by a slot 168 through which assembly screw 180 passes, allowing lifter slide 136 to move along the length of slot 168. Assembly screw 180 is threaded to a post (not shown) in track 110, thereby connecting lifter slide 136 and track 110.

Continued depression of button 152 extends lifter springs 166, which are secured to the bottom of the lifter slide 136 and to the track 110. One end 170 of each lifter spring 166 is attached to a hook 172 on track 110, while the second end 174 of each lifter spring 166 is attached to a hook 184 on lifter slide 136, as shown in FIG. 26. In this manner, lifter springs 166 urge lifter slide 136 in a forward direction. It should be noted that pulling on button 152 after it has been activated does not substantially speed up travel of lifter slide 136 to its forward most position, preventing a user from speeding up the time delay feature manually. In some embodiments, button 152 may be a telescoping handle that detaches from the rest of the pusher assembly 68 so that a user cannot override the time delay feature by pulling on the button.

Depressing the button 152 forces the lifter slide 136 in a rearward direction so that the lifter 178 is forced to slide up ramp 164 and through track opening 176. Lifter 178 lifts the next product held against lip 116 by pushing ram 112. Because of the tension in the spring 114, pushing ram 112 pushes the lifted product forward over the lip 116 and into the product dispensing area. The user then opens the front panel 12 to remove the product. As described above, opening front panel 12 causes the top panel 16 to drop down to block access to the next product. In this manner, no other products are accessible to the user.

As one product is removed, the force of the spring 114 causes the pushing ram 112 to move forward along the track 110 until the first of the remaining products contact the lifter 178. As the lifter slide 136 returns to its forward most position, the lifter 178 retracts causing the pushing ram 112 to advance the first product until the product contacts the lip 116 and is positioned above the lifter.

The resistance mechanism 148 substantially reduces the speed at which the lifter slide 136 returns to its forward position. The internal gears of the resistance mechanism are preferably configured to provide resistance to the forward movement by limiting the rotation of the external gear 146. As explained above, resistance mechanism can be any mechanism that causes resistance, such as an interference motor or a rotary damper. Because the external gear 146 engages gear teeth 144 of gear rack 142 and the external gear rotation is limited, the movement of the lifter slide 136 toward button 152 is substantially slowed.

Figure 29:
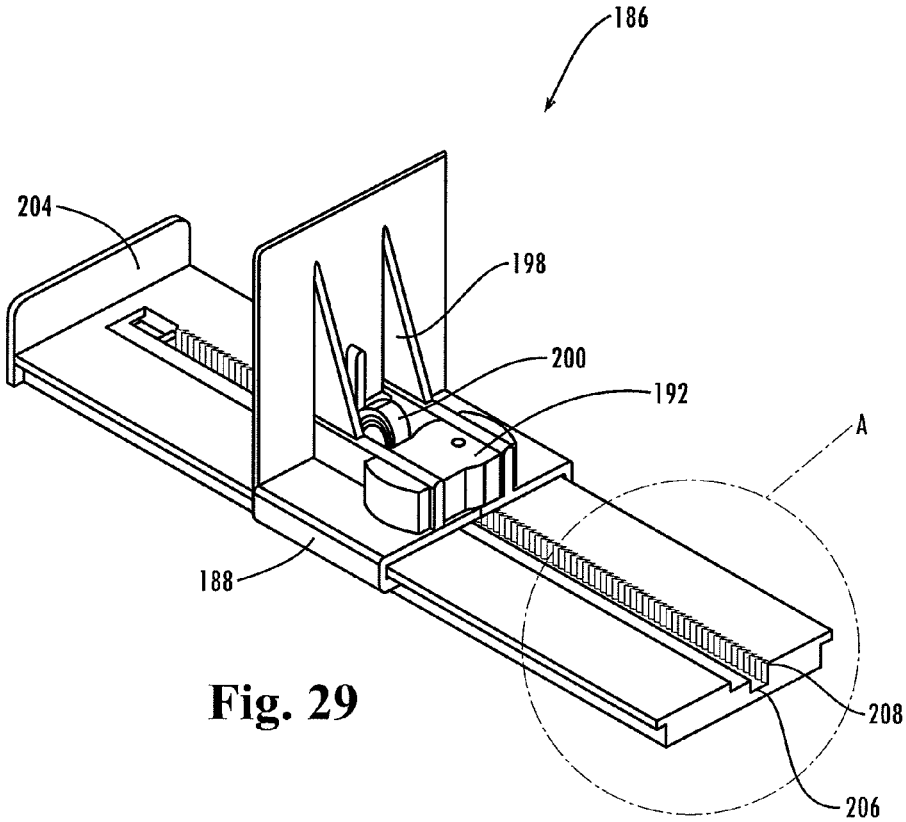
FIG. 29 is a perspective view of a pushing device according to embodiments of the invention.
Figure 30:
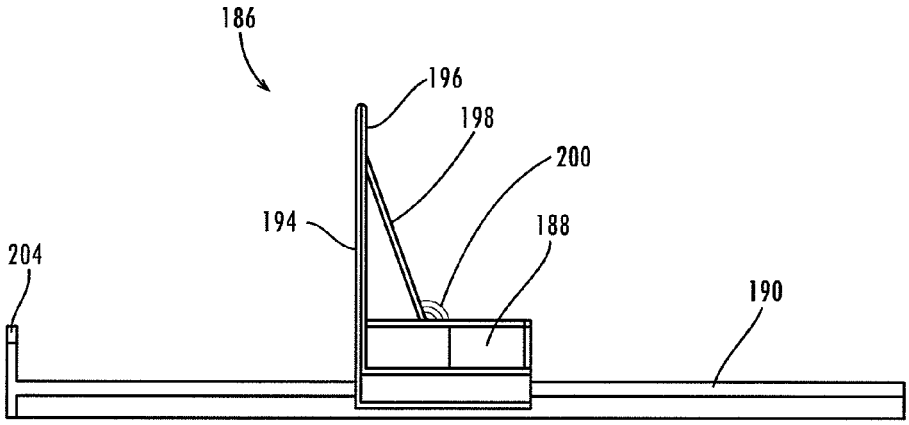
FIG. 30 is a side view of the pushing device of FIG. 29.

In certain alternative embodiments of a pusher assembly of this invention, shown in FIGS. 29-33, the pusher assembly 186 comprises a pushing ram 188, a track 190, and a resistance mechanism 192. Pushing ram 188 engages product (not shown) and pushes product forward. As shown in FIG. 30, pushing ram 188 includes a front surface 194 for engaging product and a rear surface 196. Pushing ram 188 includes gusset 198 (shown in FIG. 30), reinforcing pushing ram 188 and providing a housing for spring 200 (further described below).

Figure 31:
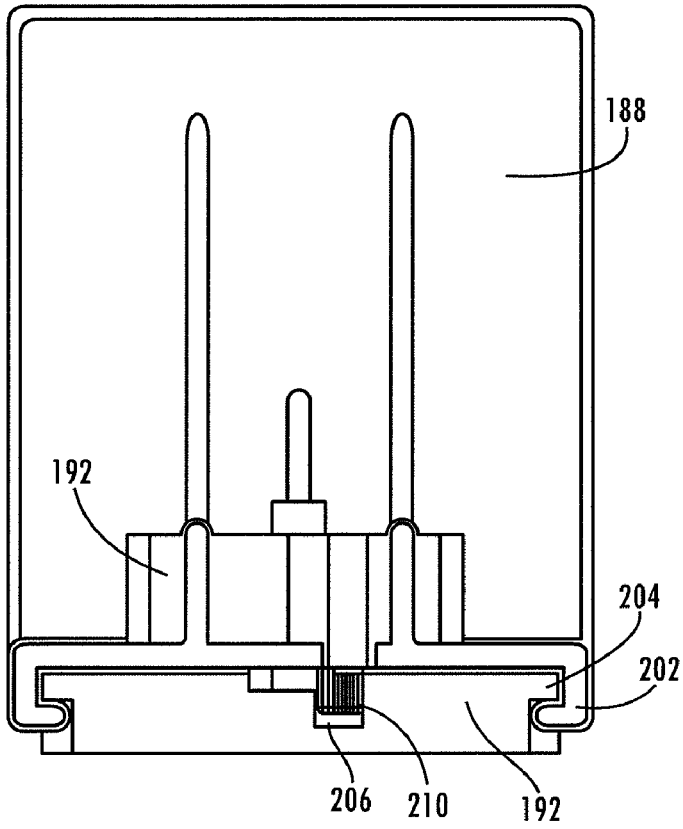
FIG. 31 is a rear view of the pushing device of FIG. 29.

As shown in FIG. 31 and similar to the embodiments described above, extension 202 of pushing ram 188 extends beyond the bottom portion of pushing ram 188. In this manner, extension 202 engages lip 204 of track 190, so that pushing ram 188 is in sliding engagement with track 190.

Figure 32:
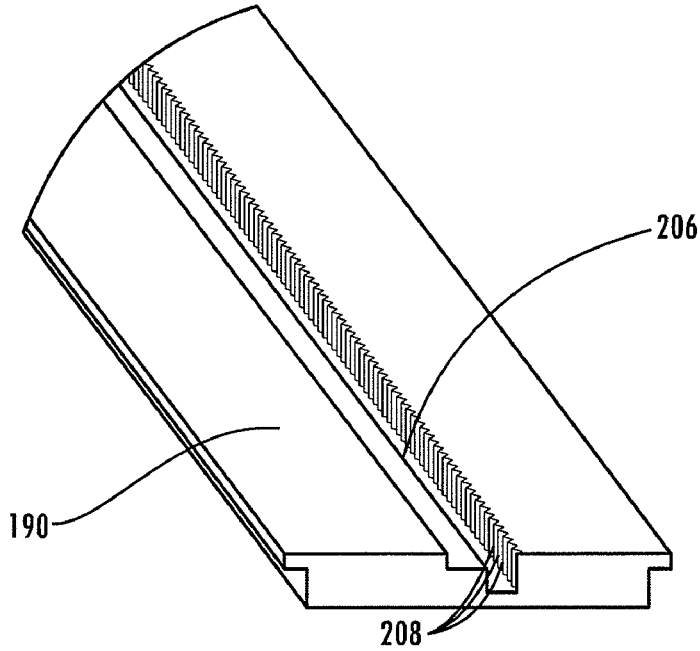
FIG. 32 is an enlarged detail view taken at A in FIG. 29.

As shown in FIG. 29, track 190 includes a central channel 206 having side walls. As shown in FIG. 32, exposed gear teeth 208 on a side wall of the central channel 206 project into channel 206 and an engage external gear (such as external gear 210 shown in FIG. 31) of the resistance mechanism 192. The gear teeth may be positioned in various other manners along the track and maintain the functionality of the pushing assembly. Resistance mechanism 192 is attached to pushing ram 188 and includes a housing and an external gear 210. Resistance mechanism 192 is positioned on pushing ram 188 so that external gear 210 extends into channel 206 of track 190 and engages gear teeth 208.

Figure 33:
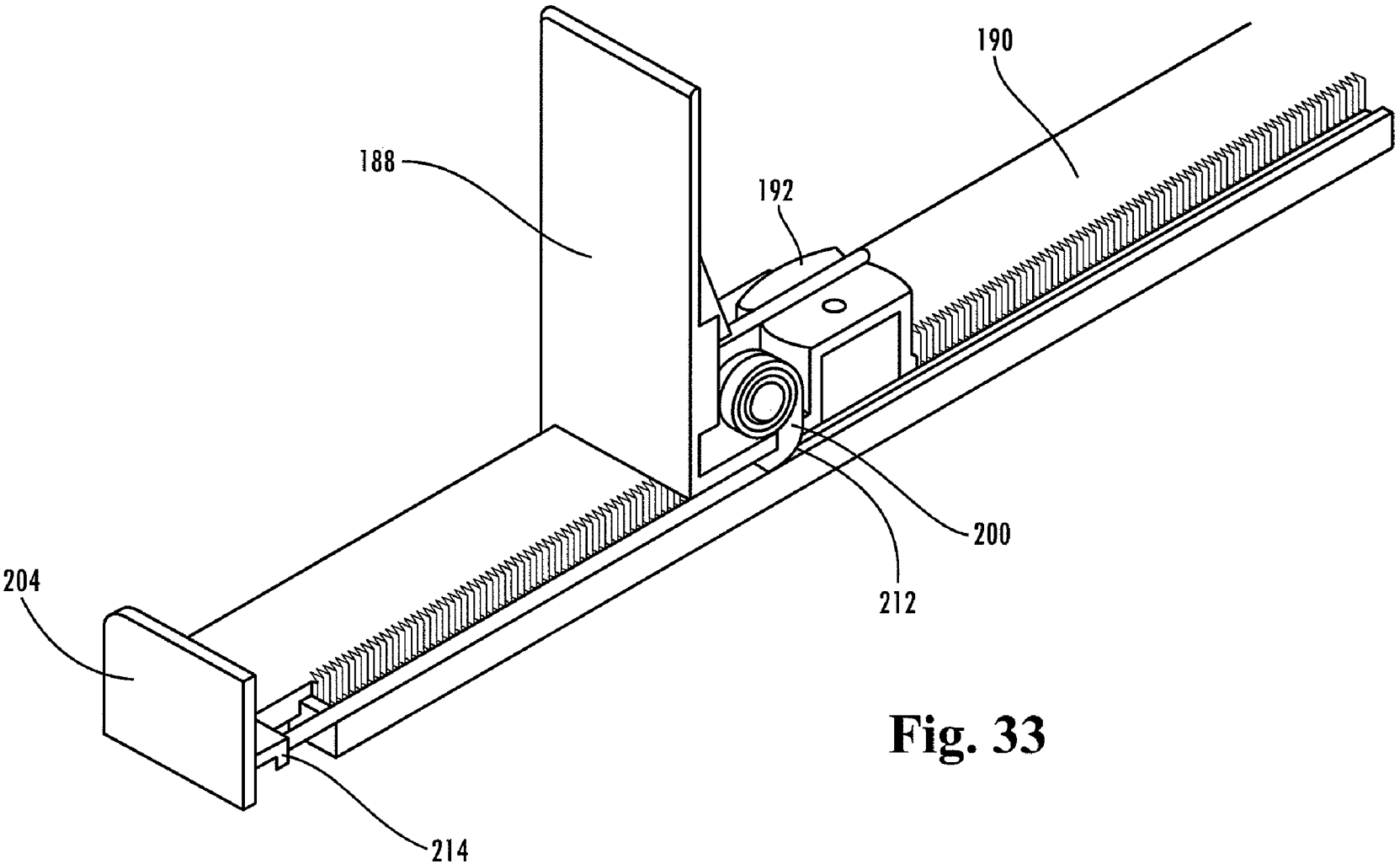
FIG. 33 is a perspective view in partial cross-section of the pushing device of FIG. 29.
Figure 34:
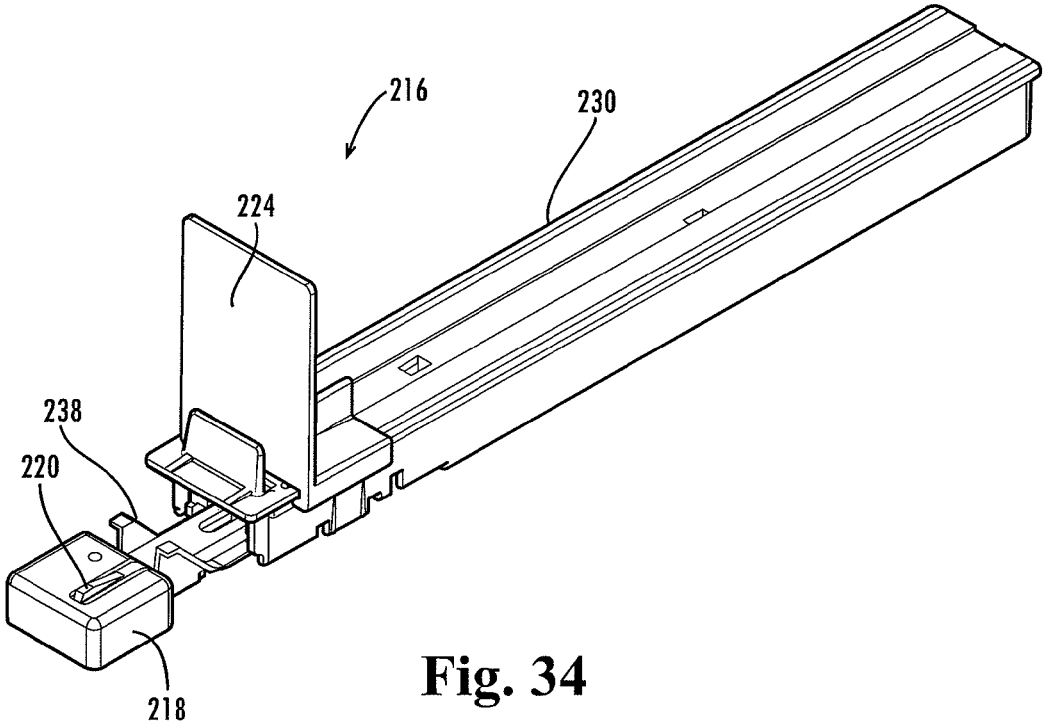
FIG. 34 is a perspective view of an alternative embodiment of a pusher assembly of this invention.
Figure 35:
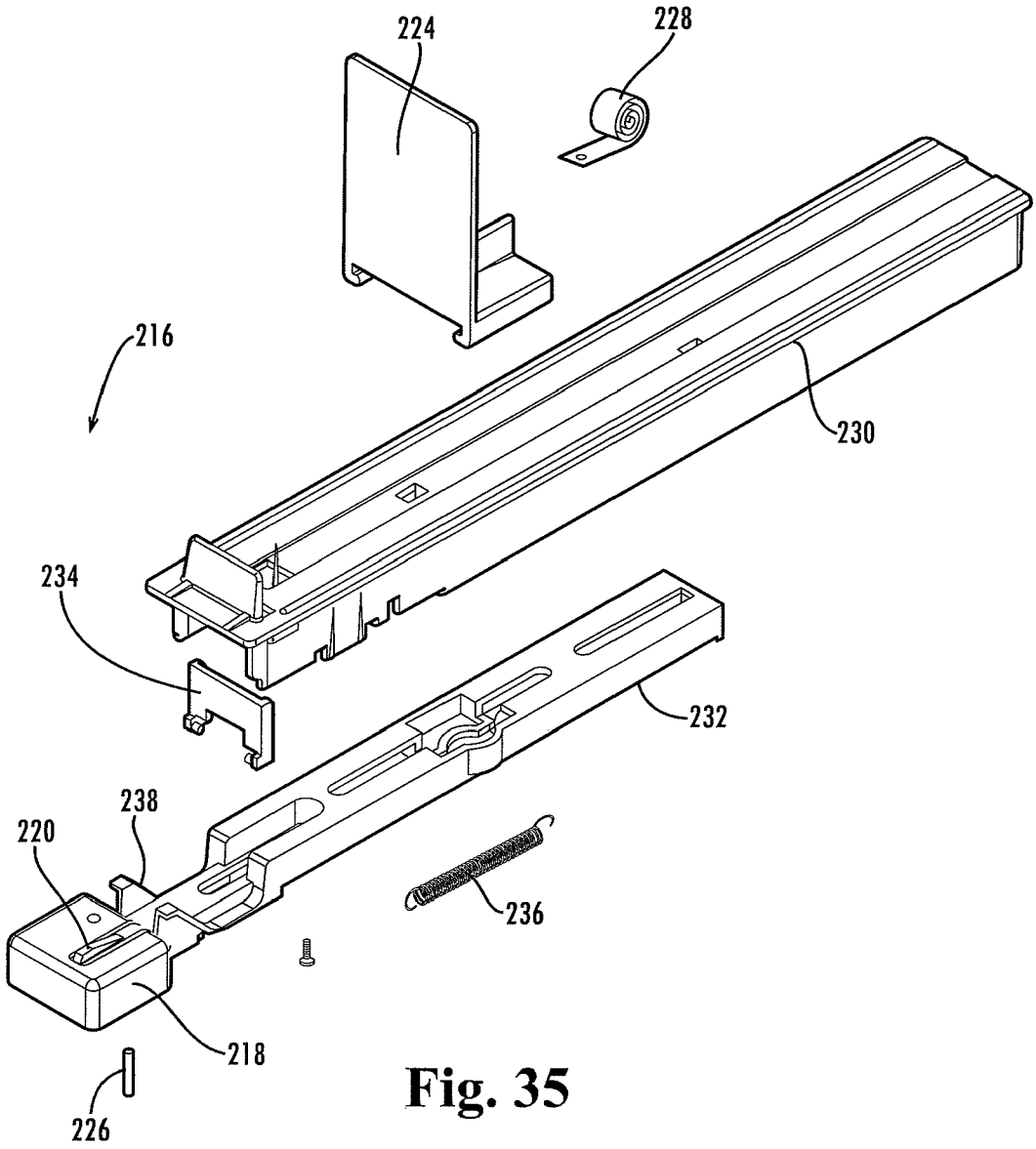
FIG. 35 is an exploded perspective view of the pusher assembly of FIG. 34.

As shown in FIG. 33, spring 200 extends through a small slot 212 and an aperture in the end of the spring 200 engages a post 214 on the track 190. Spring 200 may also be attached to pusher assembly 186 in any other suitable manner. Movement of pushing ram 188 toward the back end of the track 190 unwinds spring 200 so that spring 200 urges pushing ram 188 in the forward direction. The spring may preferably be a constant force spring, such as those sold under the trademark Conforce®, but many other types of springs, such as a variable force spring, may also be used.

Product can be loaded into the pusher assembly 186 by forcing pushing ram 188 backwards along track 190 and placing multiple units of the product against the pushing ram 188. A lip 204 or wall may be located at the front of the display device so that the multiple units of product are located between the pushing ram 188 and the lip 204. As described above, spring 200 causes the pushing ram 188 to exert force on the products towards the front of the track 190. Resistance mechanism preferably allows pushing ram to be forced backwards freely for loading of the product.

As one product is selected from the front of the pusher assembly 186, the compression of the spring 200 causes pushing ram 188 to move forward and the external gear 210 to rotate along gear teeth 208. This in turn causes the remaining product to move forward along track 190 until the remaining products engage the front lip 204. Resistance mechanism 192, however, substantially reduces the speed of this forward progression. The internal gears of the resistance mechanism 192 are preferably configured to provide resistance to the forward movement by limiting the rotation of the external gear 210. Because the external gear 210 engage the gear teeth 208 of the track 190 and the external gear rotation is limited, the movement of the pushing ram 188 and therefore the remaining product to the front of the track 190 is substantially slowed.

Certain embodiments of the anti-theft system may include a sound to alert store employees that a product is being dispensed. The system preferably includes means for producing a clearly audible sound. For example, the system may include a clicker for providing an audible clicking sound. The clicker may be incorporated into a spring so that the sound is heard when the spring is recoiled after engaging the actuator, such as button 152 of FIG. 23. In other embodiments, the sound producing mechanism may be incorporated into the resistance mechanism and may produce a ratchet sound. In other embodiments, the system can include an audible beeping sound. For example, engaging the actuator may activate an electronically produced beeping sound or an audible message when a product is dispensed. The audible sound alerts persons in the vicinity that a product is in the position to be removed. This may attract the attention of a store clerk or others and deter thieves or the removal of multiple product units.

In certain embodiments, a switch and cover interact with the notch of the slide lock, allowing the switch to open and close and sending a signal via wires or a transmitter (not shown) to a PA system. An audible tone then alerts store personnel that the cabinet is being accessed. In another embodiment, an additional switch is provided which is triggered if the front door is opened too long. In one embodiment, a transmitter unit is triggered by opening the dispenser module. The transmitter then transmits a signal to a receiver that may or may not be remotely located.

The dispensing module discussed above could be integrated with an inventory control system to monitor the quantity, location, and status of product contained with each pusher assembly.

The foregoing description is provided for describing various embodiments and structures relating to the invention. Various modifications, additions and deletions may be made to these embodiments and/or structures without departing from the scope and spirit of the invention.

The invention claimed is:

1. A dispensing module comprising:

(a) a door assembly having an open position and a closed position comprising:

(i) a tray;

(ii) a front panel having a top surface, the front panel being movable between a closed position and an open position;

(iii) a top panel;

(iv) a door arm that couples movement between the front panel and the top panel; and (v) a link arm that couples movement between the tray and the top panel, wherein as the front panel moves from the closed position to the open position, the tray rotates toward a front of the dispensing module and the top panel rotates so that the top panel is positioned relative to the top surface of the front panel in a manner that blocks access to any product stored inside the dispensing module; and (b) one or more pusher systems for pushing product forward.

2. The dispensing module of claim 1, wherein the door arm comprises a first end coupled with the front panel and a second end coupled with the top panel.

3. The dispensing module of claim 1, wherein the link arm comprises a first end coupled with the top panel and a second end coupled with the tray.

4. The dispensing module of claim 1, further comprising at least one side panel.

5. The dispensing module of claim 4, wherein the tray further comprises a pivot coupled to the at least one side panel and about which the tray rotates.

6. The dispensing module of claim 1, further comprising a spring that urges the door assembly to the closed position.

7. The dispensing module of claim 6, wherein the spring has a first end coupled with the at least one side panel and a second end coupled with the door arm.

8. The dispensing module of claim 4, wherein the at least one side panel further comprises a first opening through which the link arm passes for limiting the movement of the front panel as it is opened.

9. The dispensing module of claim 8, wherein the first opening limits the movement of the second end of the link arm as the door assembly moves between the open and the closed position.

10. The dispensing module of claim 8, wherein the at least one side panel further comprises a second opening, wherein the second opening limits the movement of the first end of the link arm as the door assembly moves between the open and the closed position.

11. The dispensing module of claim 10, wherein the at least one side panel further comprises a third opening, wherein the third opening limits the movement of the second end of the door arm as the door assembly moves between the open and the closed position.

12. The dispensing module of claim 1, wherein the at least one of the one or more pusher systems comprises:

(i) a track comprising a front lip;

(ii) a pushing ram in sliding engagement with the track and that holds product against the front lip; and (iii) a spring that urges the pushing ram toward the front of the track.

13. The dispensing module of claim 1, further comprising a resistance mechanism that slows the speed at which the spring urges the pushing ram forward.

14. The dispensing module of claim 1, further comprising a lockout assembly, wherein the lockout assembly comprises:

(a) a plurality of actuators accessible to the user and comprising a pin; and (b) a lockout bar comprising a plurality of channels configured to accept the pin of one of the plurality of actuators, wherein the channels are shaped so that when the pin of one of the plurality of actuators enters a channel, the lockout bar shifts, preventing access to the remaining channels so that only one actuator can be activated at one time.

15. The dispensing module of claim 1, further comprising a time delay after a product is dispensed before the module will dispense a second product.

16. The dispensing module of claim 15, wherein the time delay further comprises:

(i) a resistance mechanism; and (ii) an actuator accessible to the user and attached to the resistance mechanism, the actuator having a ready position wherein activation of the actuator from the ready position to an activated position causes a product to be dispensed, wherein the resistance mechanism delays the actuator returning to the ready position.

17. The dispensing module of claim 1, further comprising a sound producing mechanism.

18. The dispensing module of claim 12, wherein at least one of the one or more pusher systems further comprises a product lifter housed under an aperture in the track, wherein activation of one of the one or more pusher systems lifts the product lifter through the aperture and lifts a product resting on the lifter above the front lip, allowing the force of the spring to push the product over the top of the lip.

19. The dispensing module of claim 18, wherein at least one of the one or more pusher systems further comprises a lifter slide coupled to the track, wherein activation of the at least one of the one or more pusher system moves the lifter slide from a starting position to an extended position, and wherein when in the extended position, the lifter slide lifts the product lifter.

20. The dispensing module of claim 19, further comprising a resistance mechanism that slows the speed at which the lifter slide returns to its starting position.

21. The dispensing module of claim 14, wherein each of the plurality of actuators cooperates with one of the one or more pusher systems, and wherein activation of the actuator activates the pusher system.

22. A cabinet assembly comprising:

(a) a housing;

(b) a plurality of dispensing modules further comprising:

(i) a door assembly having an open position and a closed position comprising:

(1) a tray;

(2) a front panel having a top surface, the front panel being movable between a closed position and an open position;

(3) a top panel;

(4) a door arm that couples movement between the front panel and the top panel; and (5) a link arm that couples movement between the tray and the top panel, wherein as the front panel moves from the closed position to the open position, the tray rotates toward a front of the dispensing module and the top panel rotates so that the top panel is positioned relative to the top surface of the front panel in a manner that blocks access to any product stored inside the dispensing module; and (ii) one or more pusher systems for pushing product forward.

23. The cabinet assembly of claim 22, wherein at least one of the plurality of dispensing units further comprises a slide to allow the at least one dispensing module to slide in and out of the cabinet assembly.

24. The cabinet assembly of claim 22, wherein at least one of the plurality of dispensing units further comprises a lock that prevents the at least one dispensing module from being removed from the cabinet assembly when the lock is in a locked position.

25. The cabinet assembly of claim 22, wherein the housing may be reconfigured to house various sized dispensing modules.

26. A dispensing module comprising:

(a) a door assembly having an open position and a closed position comprising:

(i) a tray;

(ii) a front panel having a top surface, the front panel being movable between a closed position and an open position;

(iii) a top panel; and (iv) a coupling mechanism that couples movement between the front panel, the top panel, and the tray, wherein as the front panel moves from the closed position to the open position, the tray rotates toward a front of the dispensing module and the top panel rotates so that the top panel is positioned relative to the top surface of the front panel in a manner that blocks access to any product stored inside the dispensing module; and (b) one or more pusher systems for pushing product forward, at least one of the one or more pusher systems comprising:

(i) a track comprising a front lip;

(ii) a pushing ram in sliding engagement with the track and that holds product against the front lip; and (iii) a spring that urges the pushing ram toward the front of the track.

27. The dispensing module of claim 26, further comprising a lockout assembly, wherein the lockout assembly comprises:

(a) a plurality of actuators accessible to the user and comprising a pin; and (b) a lockout bar comprising a plurality of channels configured to accept the pin of one of the plurality of actuators, wherein the channels are shaped so that when the pin of one of the plurality of actuators enters a channel, the lockout bar shifts, preventing access to the remaining channels so that only one actuator can be activated at one time.

28. The dispensing module of claim 26, further comprising:

(i) a resistance mechanism; and (ii) an actuator accessible to the user and attached to the resistance mechanism, the actuator having a ready position wherein activation of the actuator from the ready position to an activated position causes a product to be dispensed, wherein the resistance mechanism delays the actuator returning to the ready position.

29. The dispensing module of claim 26, wherein at least one of the one or more pusher systems further comprises a product lifter housed under an aperture in the track, wherein activation of one of the one or more pusher systems lifts the product lifter through the aperture and lifts a product resting on the lifter above the front lip, allowing the force of the spring to push the product over the top of the lip.

30. The dispensing module of claim 29, wherein at least one of the one or more pusher systems further comprises a lifter slide coupled to the track, wherein activation of the at least one of the one or more pusher system moves the lifter slide from a starting position to an extended position, and wherein when in the extended position, the lifter slide lifts the product lifter.

31. The dispensing module of claim 30, further comprising a resistance mechanism that slows the speed at which the lifter slide returns to its starting position.

32. The dispensing module of claim 27, wherein each of the plurality of actuators cooperates with one of the one or more pusher systems, and wherein activation of the actuator activates the pusher system.

33. The dispensing module of claim 26, further comprising a resistance mechanism that slows the speed at which the spring urges the pushing ram forward.

* * * * *